US012140003B2

(12) United States Patent
Rashid et al.

(10) Patent No.: US 12,140,003 B2
(45) Date of Patent: Nov. 12, 2024

(54) GAS-LIFT CONTROL

(71) Applicant: Schlumberger Technology Corporation, Sugar Land, TX (US)

(72) Inventors: Kashif Rashid, Cambridge, MA (US); Agustin Gambaretto, Houston, TX (US)

(73) Assignee: Schlumberger Technology Corporation, Sugar Land, AS (US)

( * ) Notice: Subject to any disclaimer, the term of this patent is extended or adjusted under 35 U.S.C. 154(b) by 0 days.

(21) Appl. No.: 18/683,812

(22) PCT Filed: Sep. 8, 2022

(86) PCT No.: PCT/US2022/042843
§ 371 (c)(1),
(2) Date: Feb. 15, 2024

(87) PCT Pub. No.: WO2023/039025
PCT Pub. Date: Mar. 16, 2023

(65) Prior Publication Data

US 2024/0328289 A1 Oct. 3, 2024

Related U.S. Application Data

(60) Provisional application No. 63/242,117, filed on Sep. 9, 2021.

(51) Int. Cl.
*E21B 43/12* (2006.01)
*E21B 49/08* (2006.01)

(52) U.S. Cl.
CPC ..... *E21B 43/122* (2013.01); *E21B 49/087* (2013.01)

(58) Field of Classification Search
CPC ..... E21B 43/122; E21B 49/087
See application file for complete search history.

(56) References Cited

U.S. PATENT DOCUMENTS

| | | | |
|---|---|---|---|
| 9,951,601 | B2 | 4/2018 | Rashid et al. |
| 11,773,700 | B2 | 10/2023 | Ramakrishnan et al. |
| 2008/0154564 | A1 | 6/2008 | Rashid |

(Continued)

OTHER PUBLICATIONS

International Search Report and Written Opinion issued in International Patent Application No. PCT/US2022/042843 on Dec. 28, 2022; 10 pages.

(Continued)

*Primary Examiner* — Kristyn A Hall
(74) *Attorney, Agent, or Firm* — Jeffrey D. Frantz

(57) ABSTRACT

A method can include receiving a number of samples of liquid production values and associated gas-lift injection rates for one of one or more wells; determining a prospective optimal gas-lift injection rate for the one of the one or more wells via a regression that fits the number of samples; responsive to the prospective optimal gas-lift injection rate satisfying one or more gas-lift injection rate criteria, issuing an instruction to implement the prospective optimal gas-lift injection rate for the one of the one or more wells; receiving a new sample as a measured liquid production value for the implemented prospective optimal gas-lift injection rate and responsive to satisfaction of one or more compliance criteria; and replacing one of the number of samples with the new sample.

17 Claims, 19 Drawing Sheets

(56) References Cited

U.S. PATENT DOCUMENTS

| | | | | |
|---|---|---|---|---|
| 2017/0343986 | A1* | 11/2017 | Zhang | E21B 43/123 |
| 2021/0198988 | A1 | 7/2021 | Ramakrishnan et al. | |
| 2021/0332684 | A1* | 10/2021 | Madasu | E21B 43/26 |

OTHER PUBLICATIONS

Alarcon et al., "Global Optimization of Gas Allocation to a Group of Wells in Artificial Lifting Using Nonlinear Constrained Programming", Journal of Energy Resources Technology, Dec. 2002, vol. 124, pp. 262-268.

Dutta et al., "Optimization of Continuous Gas Lift wells based on Well Modeling, Surveillance, Diagnostics and Lift Gas Reallocation in a Mature Offshore Oil Field", Intentional Journal of Engineering and Advanced Technology (IJEAT), Oct. 2019, vol. 9, Issue 1, pp. 6037-6049.

Rashid, K., An Optimal Allocation Procedure for Gas-Lift Optimization, J. of Industrial and Engineering Chemistry Research, 49, No. 5, pp. 2286-2294, 2010. 9 pages.

Rashid, K., Bailey, W.J. and Couet, B., Review Article: A Survey of Methods for Gas Lift Optimization, J. of Modeling and Simulation in Engineering, Hindawi Publishing Corp, vol. 2012, Article ID 516807, Sep. 2012. 17 pages.

Boyd, S. and Vandenberghe, L., Convex Optimization, Cambridge University Press, 2004. 4 pages.

* cited by examiner

GAS-LIFT CONTROL

CROSS-REFERENCE TO RELATED APPLICATION(S)

The present disclosure claims priority from U.S. Provisional Patent Appl. No. 63/242,117, filed on Sep. 9, 2021, entitled "Gas-Lift Control," herein incorporated by reference in its entirety.

BACKGROUND

Various techniques can be utilized for artificial-lift, which can, for example, help to produce fluid from a reservoir, etc. Gas-lift is a type of artificial-lift where, for example, gas can be injected into production tubing to reduce hydrostatic pressure of a fluid column. In such an approach a resulting reduction in bottomhole pressure can allow reservoir fluid to enter a wellbore at a higher flow rate. In various instances, injection gas can be conveyed down a tubing-casing annulus and enter a production train through one or more gas-lift valves.

SUMMARY

A method can include receiving a number of samples of liquid production values and associated gas-lift injection rates for one of one or more wells; determining a prospective optimal gas-lift injection rate for the one of the one or more wells via a regression that fits the number of samples; responsive to the prospective optimal gas-lift injection rate satisfying one or more gas-lift injection rate criteria, issuing an instruction to implement the prospective optimal gas-lift injection rate for the one of the one or more wells; receiving a new sample as a measured liquid production value for the implemented prospective optimal gas-lift injection rate and responsive to satisfaction of one or more compliance criteria; and replacing one of the number of samples with the new sample. A system can include one or more processors; memory accessible to at least one of the one or more processors; processor-executable instructions stored in the memory and executable to instruct the system to: receive a number of samples of liquid production values and associated gas-lift injection rates for one of one or more wells, where the number of samples equals a pre-defined sample number; determine a prospective optimal gas-lift injection rate for the one of the one or more wells via a regression that fits the number of samples; responsive to the prospective optimal gas-lift injection rate satisfying one or more gas-lift injection rate criteria, issue an instruction to implement the prospective optimal gas-lift injection rate for the one of the one or more wells; receive a new sample as a measured liquid production value for the implemented prospective optimal gas-lift injection rate and responsive to satisfaction of one or more compliance criteria; and replace one of the number of samples with the new sample. One or more computer-readable storage media can include processor-executable instructions to instruct a computing system to: receive a number of samples of liquid production values and associated gas-lift injection rates for one of one or more wells, where the number of samples equals a pre-defined sample number; determine a prospective optimal gas-lift injection rate for the one of the one or more wells via a regression that fits the number of samples; responsive to the prospective optimal gas-lift injection rate satisfying one or more gas-lift injection rate criteria, issue an instruction to implement the prospective optimal gas-lift injection rate for the one of the one or more wells; receive a new sample as a measured liquid production value for the implemented prospective optimal gas-lift injection rate and responsive to satisfaction of one or more compliance criteria; and replace one of the number of samples with the new sample This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
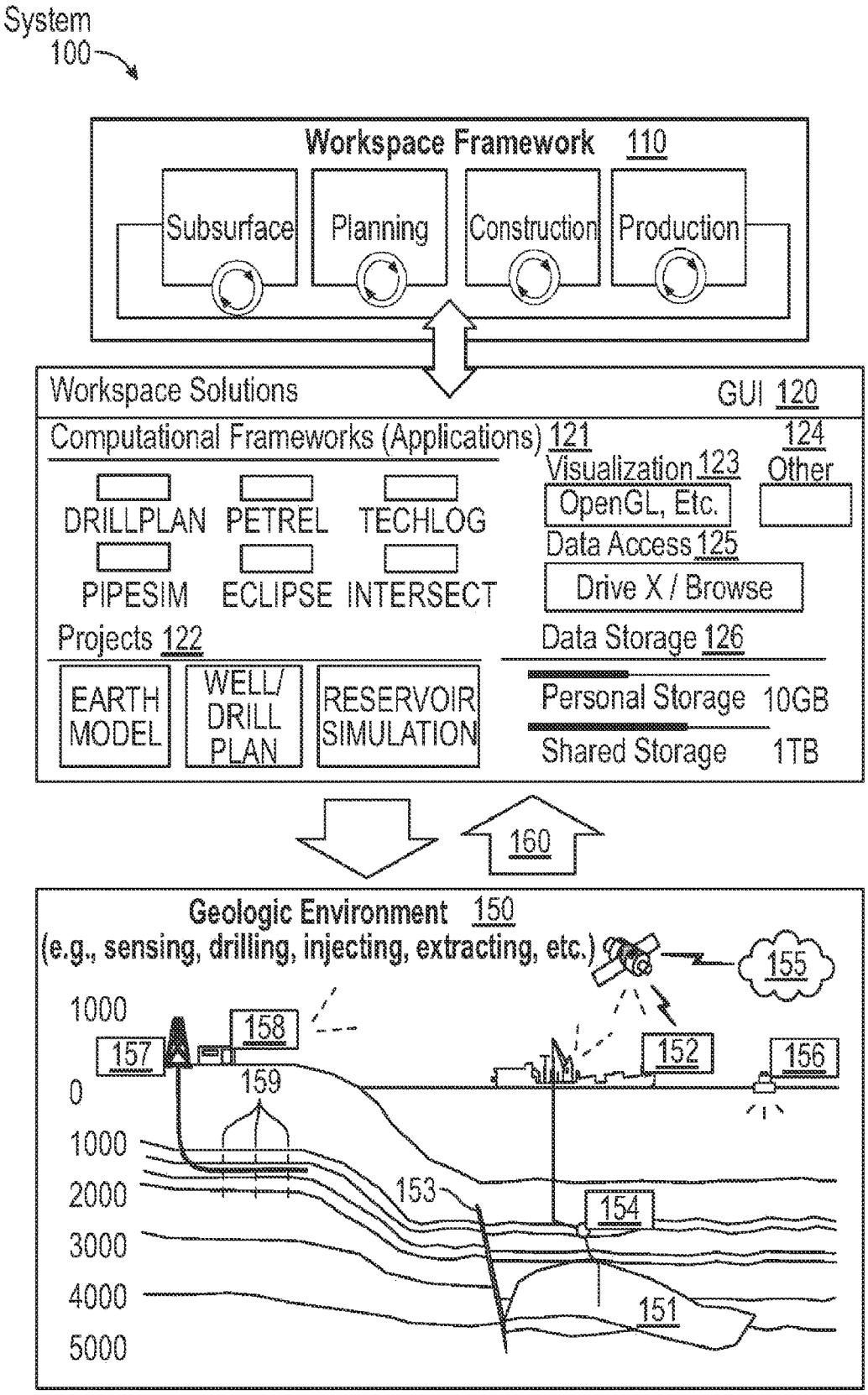
FIG. 1 illustrates an example of a system.

FIG. 1 shows an example of a system 100 that includes a workspace framework 110 that can provide for instantiation of, rendering of, interactions with, etc., a graphical user interface (GUI) 120. In the example of FIG. 1, the GUI 120 can include graphical controls for computational frameworks (e.g., applications) 121, projects 122, visualization 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, PETREL, TECHLOG, PIPESIM, ECLIPSE, and INTERSECT frameworks (Schlumberger Limited, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The PETREL framework can be part of the DELFI cognitive E&P environment (Schlumberger Limited, Houston, Texas) for utilization in geosciences and geoengineering, for example, to analyze subsurface data from exploration to production of fluid from a reservoir.

The TECHLOG framework can handle and process field and laboratory data for a variety of geologic environments (e.g., deepwater exploration, shale, etc.). The TECHLOG framework can structure wellbore data for analyses, planning, etc.

The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (Schlumberger Limited, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that can optimize one or more operational scenarios at least in part via simulation of physical phenomena.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework can produce reliable results, which may be continuously updated by real-time data exchanges (e.g., from one or more types of data acquisition equipment in the field that can acquire data during one or more types of field operations, etc.). The INTERSECT framework can provide completion configurations for complex wells where such configurations can be built in the field, can provide detailed chemical-enhanced-oil-recovery (EOR) formulations where such formulations can be implemented in the field, can analyze application of steam injection and other thermal FOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI cognitive E&P environment, for example, for rapid simulation of multiple concurrent cases. For example, a workflow may utilize one or more of the DELFI on demand reservoir simulation features.

The aforementioned DELFI environment provides various features for workflows as to subsurface analysis, planning, construction, and production, for example, as illustrated in the workspace framework 110. As shown in FIG. 1, outputs from the workspace framework 110 can be utilized for directing, controlling, etc., one or more processes in the geologic environment 150 and, feedback 160, can be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G software packages. Examples of such software packages include the PETREL framework. As an example, a system or systems may utilize a framework such as the DELFI framework (Schlumberger Limited, Houston, Texas). Such a framework may operatively couple various other frameworks to provide for a multi-framework workspace. As an example, the GUI 120 of FIG. 1 may be a GUI of the DELFI framework.

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, a visualization process can implement one or more of various features that can be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter.

As an example, visualization features can provide for visualization of various earth models, properties, etc., in one or more dimensions. As an example, visualization features can provide for rendering of information in multiple dimensions, which may optionally include multiple resolution rendering. In such an example, information being rendered may be associated with one or more frameworks and/or one or more data stores. As an example, visualization features may include one or more control features for control of equipment, which can include, for example, field equipment that can perform one or more field operations. As an example, a workflow may utilize one or more frameworks to generate information that can be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results can be utilized to plan, simulate, perform, etc., one or more operations for production of fluid from a reservoir (e.g., reservoir rock, etc.).

Field acquisition equipment may be utilized to acquire seismic data, which may be in the form of traces where a trace can include values organized with respect to time and/or depth (e.g., consider 1 D, 2D, 3D or 4D seismic data). For example, consider acquisition equipment that acquires digital samples at a rate of one sample per approximately 4 ms. Given a speed of sound in a medium or media, a sample rate may be converted to an approximate distance. For example, the speed of sound in rock may be on the order of around 5 km per second. Thus, a sample time spacing of approximately 4 ms would correspond to a sample "depth" spacing of about 10 meters (e.g., assuming a path length from source to boundary and boundary to sensor). As an example, a trace may be about 4 seconds in duration; thus, for a sampling rate of one sample at about 4 ms intervals, such a trace would include about 1000 samples where latter acquired samples correspond to deeper reflection boundaries. If the 4 second trace duration of the foregoing example is divided by two (e.g., to account for reflection), for a vertically aligned source and sensor, a deepest boundary depth may be estimated to be about 10 km (e.g., assuming a speed of sound of about 5 km per second).

As an example, a model may be a simulated version of a geologic environment. As an example, a simulator may include features for simulating physical phenomena in a geologic environment based at least in part on a model or models. A simulator, such as a reservoir simulator, can simulate fluid flow in a geologic environment based at least in part on a model that can be generated via a framework that receives seismic data. A simulator can be a computerized system (e.g., a computing system) that can execute instructions using one or more processors to solve a system of equations that describe physical phenomena subject to various constraints. In such an example, the system of equations may be spatially defined (e.g., numerically discretized) according to a spatial model that includes layers of rock, geobodies, etc., that have corresponding positions that can be based on interpretation of seismic and/or other data. A spatial model may be a cell-based model where cells are defined by a grid (e.g., a mesh). A cell in a cell-based model can represent a physical area or volume in a geologic environment where the cell can be assigned physical properties (e.g., permeability, fluid properties, etc.) that may be germane to one or more physical phenomena (e.g., fluid volume, fluid flow, pressure, etc.). A reservoir simulation model can be a spatial model that may be cell-based.

A simulator can be utilized to simulate the exploitation of a real reservoir, for example, to examine different productions scenarios to find an optimal one before production or further production occurs. A reservoir simulator will not provide an exact replica of flow in and production from a reservoir at least in part because the description of the reservoir and the boundary conditions for the equations for flow in a porous rock are generally known with an amount of uncertainty. Certain types of physical phenomena occur at a spatial scale that can be relatively small compared to size of a field. A balance can be struck between model scale and computational resources that results in model cell sizes being of the order of meters; rather than a lesser size (e.g., a level of detail of pores). A modeling and simulation workflow for multiphase flow in porous media (e.g., reservoir rock, etc.) can include generalizing real micro-scale data from macro scale observations (e.g., seismic data and well data) and upscaling to a manageable scale and problem size. Uncertainties can exist in input data and solution procedure such that simulation results are to some extent uncertain. A process known as history matching can involve comparing simulation results to actual field data acquired during production of fluid from a field. Information gleaned from history matching, can provide for adjustments to a model, data, etc., which can help to increase accuracy of simulation.

As an example, a simulator may utilize various types of constructs, which may be referred to as entities. Entities may include earth entities or geological objects such as wells, surfaces, reservoirs, etc. Entities can include virtual representations of actual physical entities that may be reconstructed for purposes of simulation. Entities may include entities based on data acquired via sensing, observation, etc. (e.g., consider entities based at least in part on seismic data and/or other information). As an example, an entity may be characterized by one or more properties (e.g., a geometrical pillar grid entity of an earth model may be characterized by a porosity property, etc.). Such properties may represent one or more measurements (e.g., acquired data), calculations, etc.

As an example, a simulator may utilize an object-based software framework, which may include entities based on pre-defined classes to facilitate modeling and simulation. As an example, an object class can encapsulate reusable code and associated data structures. Object classes can be used to instantiate object instances for use by a program, script, etc. For example, borehole classes may define objects for representing boreholes based on well data. A model of a basin, a reservoir, etc. may include one or more boreholes where a borehole may be, for example, for measurements, injection, production, etc. As an example, a borehole may be a wellbore of a well, which may be a completed well (e.g., for production of a resource from a reservoir, for injection of material, etc.).

While several simulators are illustrated in the example of FIG. 1, one or more other simulators may be utilized, additionally or alternatively. For example, consider the VISAGE geomechanics simulator (Schlumberger Limited, Houston Texas) or the PETROMOD simulator (Schlumberger Limited, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, $CO_2$ disposal, etc. The PETROMOD framework provides petroleum systems modeling capabilities that can combine one or more of seismic, well, and geological information to model the evolution of a sedimentary basin. The PETROMOD framework can predict if, and how, a reservoir has been charged with hydrocarbons, including the source and timing of hydrocarbon generation, migration routes, quantities, and hydrocarbon type in the subsurface or at surface conditions. The MANGROVE simulator (Schlumberger Limited, Houston, Texas) provides for optimization of stimulation design (e.g., stimulation treatment operations such as hydraulic fracturing) in a reservoir-centric environment. The MANGROVE framework can combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework can provide results pertaining to heterogeneous interactions between hydraulic and natural fracture networks, which may assist with optimization of the number and location of fracture treatment stages (e.g., stimulation treatment(s)), for example, to increased perforation efficiency and recovery.

The PETREL framework provides components that allow for optimization of exploration and development operations. The PETREL framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

As mentioned, a framework may be implemented within or in a manner operatively coupled to the DELFI cognitive exploration and production (E&P) environment (Schlumberger, Houston, Texas), which is a secure, cognitive, cloud-based collaborative environment that integrates data and workflows with digital technologies, such as artificial intelligence and machine learning. As an example, such an environment can provide for operations that involve one or more frameworks. The DELFI environment may be referred to as the DELFI framework, which may be a framework of frameworks. As an example, the DELFI framework can include various other frameworks, which can include, for example, one or more types of models (e.g., simulation models, etc.).

Figure 2:
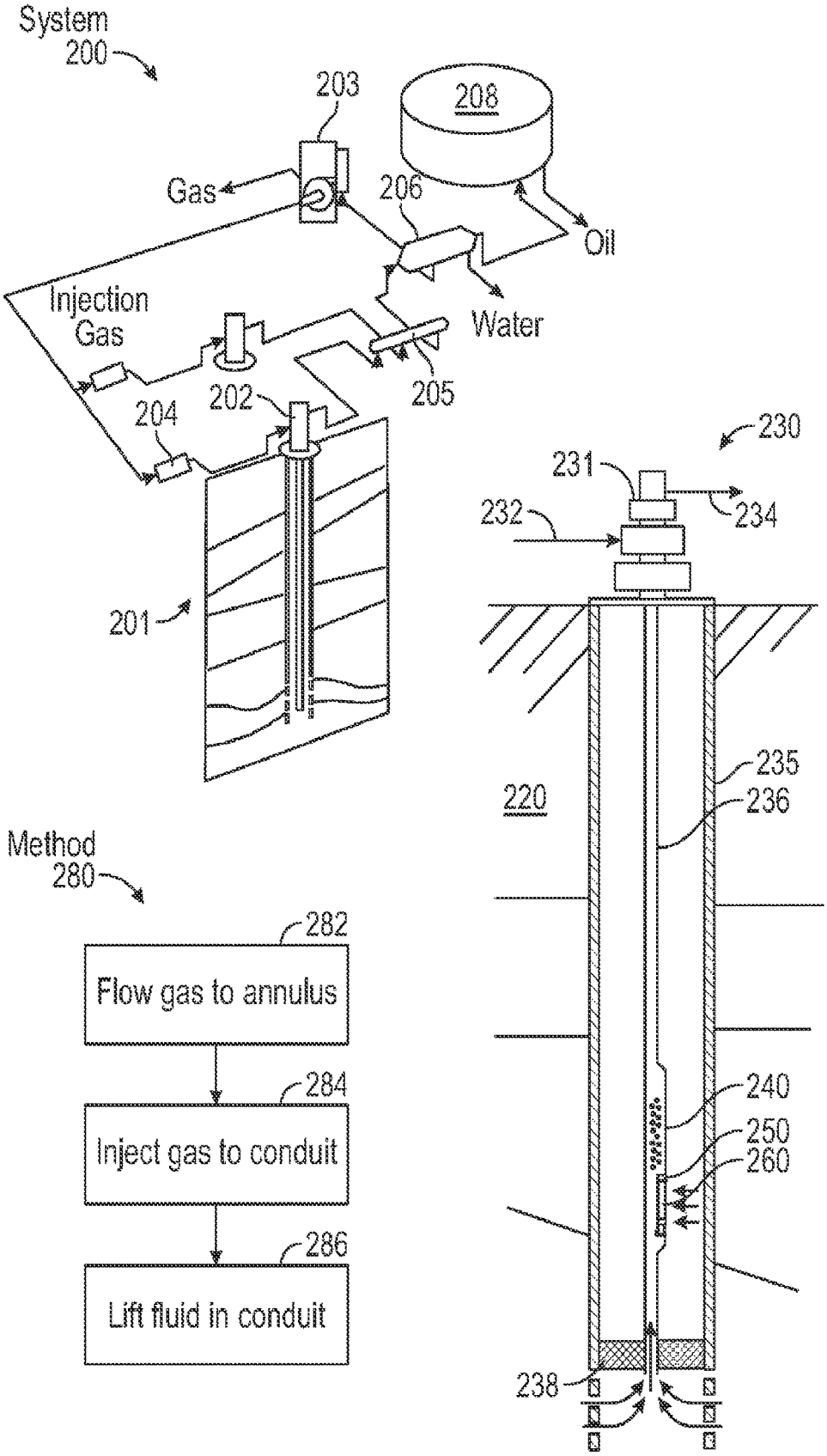
FIG. 2 illustrates an example of a system and an example of a method.

FIG. 2 shows an example of a system 200 that includes various types of equipment. As an example, the system 200 may be planned, modeled, controlled, etc., using one or more features of the system 100 of FIG. 1. For example, consider reservoir modeling where production of fluid, injection of fluid, etc., may be modeled, simulated, etc. As an example, production may decrease with respect to time for one or more wells where an artificial-lift strategy may be implemented to increase, maintain, etc., production, optionally in combination with one or more other strategies (e.g., flooding, treatment, stimulation, fracturing, etc.). As an example, the system 100 may provide estimates as to gas production where such gas may be utilized in one or more artificial-lift operations. As an example, where at least some equipment may scale and/or affect a scaling mechanism, such phenomena may be modeled, simulated, controlled, etc. For example, gas lift equipment may experience scale formation and, for example, may alter one or more of pressure, temperature, chemistry, phase dynamics, etc. A system such as the system 100 of FIG. 1 may provide for combined strategies that aim to optimize artificial lift, which may include one or more strategies as to gas production, scale mitigation, scale treatment, etc.

Gas lift (or gas-lift) is a process where, for example, gas may be injected from an annulus into tubing. An annulus, as applied to an oil well or other well for recovering a subsurface resource may refer to a space, lumen, or void between piping, tubing or casing and the piping, tubing, or casing immediately surrounding it, for example, at a greater radius.

As an example, injected gas may aerate well fluid in production tubing in a manner that "lightens" the well fluid such that the fluid can flow more readily to a surface location. As an example, one or more gas lift valves may be configured to control flow of gas during an intermittent flow or a continuous flow gas lift operation. As an example, a gas lift valve may operate based at least in part on a differential pressure control that can actuate a valve mechanism of the gas lift valve.

As gas lift valve may include a so-called hydrostatic pressure chamber that, for example, may be charged with a desired pressure of gas (e.g., nitrogen, etc.). As an example, an injection-pressure-operated (IPO) gas lift valve or an unloading valve can be configured so that an upper valve in a production string opens before a lower valve in the production string opens.

As an example, a gas lift valve may be configured, for example, in conjunction with a mandrel, for placement and/or retrieval of the gas lift valve using a tool. For example, consider a side pocket mandrel that is shaped to allow for installation of one or more components at least partially in a side pocket or side pockets where a production flow path through the side pocket mandrel may provide for access to a wellbore and completion components located below the side pocket mandrel. As an example, a side pocket mandrel can include a main axis and a pocket axis where the pocket axis is offset a radial distance from the main axis. In such an example, the main axis may be aligned with production tubing, for example, above and/or below the side pocket mandrel.

As an example, a tool may include an axial length from which a portion of the tool may be kicked-over (e.g., to a kicked-over position). In such an example, the tool may include a region that can carry a component such as a gas lift valve. An installation process may include inserting a length of the kickover tool into a side pocket mandrel (e.g., along a main axis) and kicking over a portion of the tool that carries a component toward the side pocket of the mandrel to thereby facilitate installation of the component in the side pocket. A removal process may operate in a similar manner, however, where the portion of the tool is kicked-over to facilitate latching to a component in a side pocket of a side pocket mandrel.

Where gas lift equipment is damaged by scale, one or more remedial operations may be performed; whereas, if left unmitigated, fluid production may decrease and it may be difficult to implement one or more tools (e.g., kickover tool, etc.).

In FIG. 2, the system 200 is shown with an example of a geologic environment 220 that includes equipment and an example of a method 280. The system 200 includes a subterranean formation 201 with a well 202. Injection gas is provided to the well 202 via a compressor 203 and a regulator 204. The injection gas can assist with lifting fluid that flows from the subterranean formation 201 to the well 202. The lifted fluid, including injected gas, may flow to a manifold 205, for example, where fluid from a number of wells may be combined. As shown in the example of FIG. 2, the manifold 205 is operatively coupled to a separator 206, which may separate components of the fluid. For example, the separator 206 may separate oil, water, and gas components as substantially separate phases of a multiphase fluid. In such an example, oil may be directed to an oil storage facility 208 while gas may be directed to the compressor 203, for example, for re-injection, storage and/or transport to another location. As an example, water may be directed to a water discharge, a water storage facility, etc.

As shown in FIG. 2, the geologic environment 220 is fitted with well equipment 230, which includes a well-head 231 (e.g., a Christmas tree, etc.), an inlet conduit 232 for flow of compressed gas, an outlet conduit 234 for flow of produced fluid, a casing 235, a production conduit 236, and a packer 238 that forms a seal between the casing 235 and the production conduit 236. As shown, fluid may enter the casing 235 (e.g., via perforations) and then enter a lumen of the production conduit 236, for example, due to a pressure differential between the fluid in the subterranean geologic environment 220 and the lumen of the production conduit 236 at an opening of the production conduit 236. Where the inlet conduit 232 for flow of compressed gas is used to flow gas to the annular space between the casing 235 and the production conduit 236, a mandrel 240 operatively coupled to the production conduit 236 that includes a pocket 250 that seats a gas lift valve 260 that may regulate the introduction of the compressed gas into the lumen of the production conduit 236. In such an example, the compressed gas introduced may facilitate flow of fluid upwardly to the well-head 231 (e.g., opposite a direction of gravity) where the fluid may be directed away from the well-head 231 via the outlet conduit 234.

As shown in FIG. 2, the method 280 can include a flow block 282 for flowing gas to an annulus (e.g., or, more generally, a space exterior to a production conduit fitted with a gas lift valve), an injection block 284 for injecting gas from the annulus into a production conduit via a gas lift valve or gas lift valves and a lift block 286 for lifting fluid in the production conduit due in part to buoyancy imparted by the injected gas.

As an example, where a gas lift valve includes one or more actuators, such actuators may optionally be utilized to control, at least in part, operation of a gas lift valve (e.g., one or more valve members of a gas lift valve). As an example, surface equipment can include one or more control lines that may be operatively coupled to a gas lift valve or gas lift valves, for example, where a gas lift valve may respond to a control signal or signals via the one or more control lines. As an example, surface equipment can include one or more power lines that may be operatively coupled to a gas lift valve or gas lift valves, for example, where a gas lift valve may respond to power delivered via the one or more power lines. As an example, a system can include one or more control lines and one or more power lines where, for example, a line may be a control line, a power line or a control and power line.

As an example, a production process may optionally utilize one or more fluid pumps such as, for example, an electric submersible pump (e.g., consider a centrifugal pump, a rod pump, etc.). As an example, a production process may implement one or more so-called "artificial lift" (or artificial-lift) technologies. An artificial lift technology may operate by adding energy to fluid, for example, to initiate, enhance, etc. production of fluid.

Figure 3:
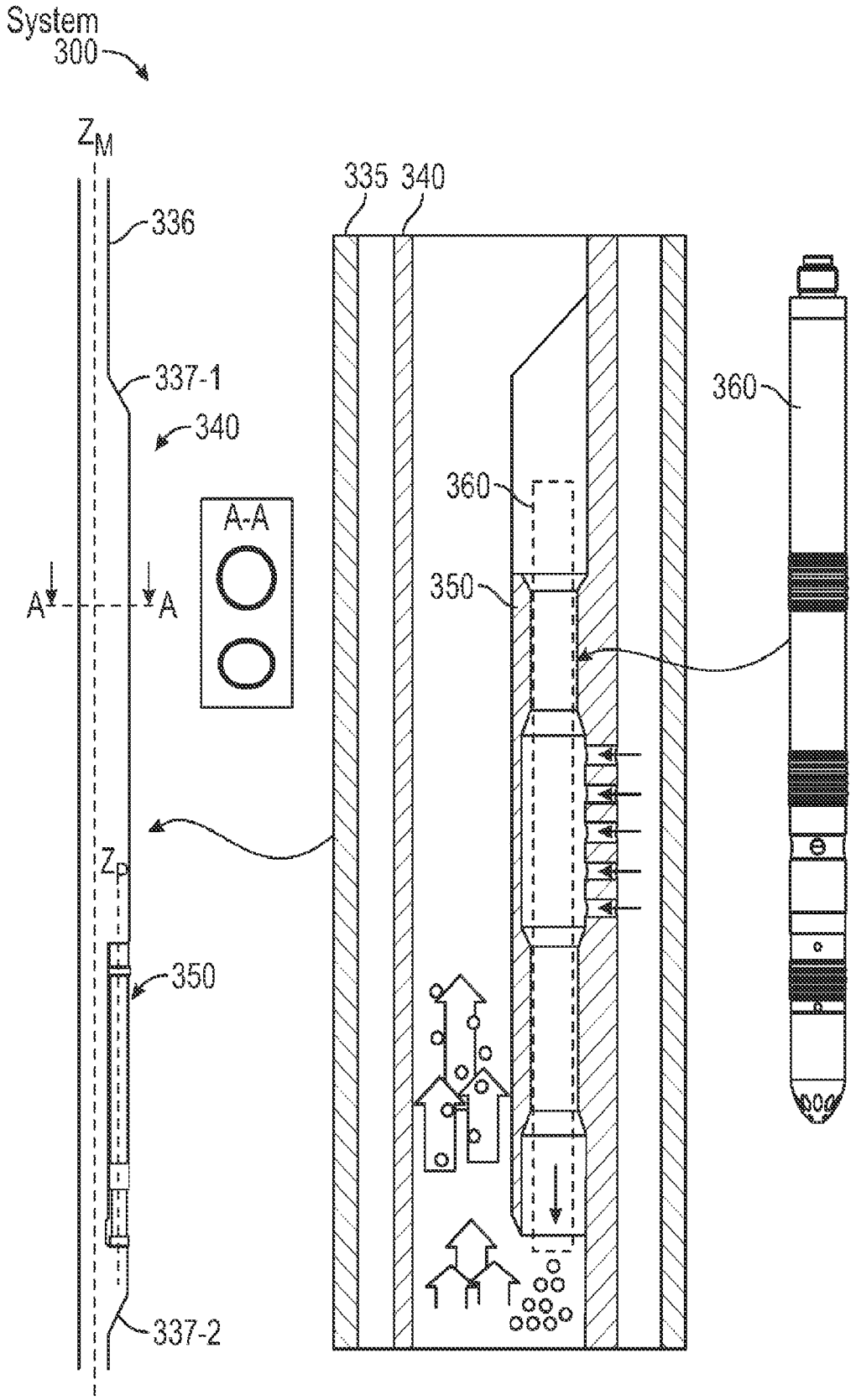
FIG. 3 illustrates an example of a system.

FIG. 3 shows an example of a system 300 that includes a casing 335, a production conduit 336 and a mandrel 340 that includes a pocket 350 that seats a gas lift valve 360. As shown, the mandrel 340 can include a main longitudinal axis ($z_M$) and a side pocket longitudinal axis ($z_P$) that is offset a radial distance from the main longitudinal axis ($z_M$). In the example of FIG. 3, the axes ($z_M$ and $z_P$) are shown as being substantially parallel such that a bore of the pocket 350 is parallel to a lumen of the mandrel 340. Also shown in FIG. 3 are two examples of cross-sectional profiles for the mandrel 340, for example, along a line A-A. As shown, a mandrel may include a circular cross-sectional profile or another shaped profile such as, for example, an oval profile.

As an example, a completion may include multiple instances of the mandrel 340, for example, where each pocket of each instance may include a gas lift valve where, for example, one or more of the gas lift valves may differ in one or more characteristics from one or more other of the gas lift valves (e.g., pressure settings, etc.).

As shown in the example of FIG. 3, the mandrel 340 can include one or more openings that provide for fluid communication with fluid in an annulus (e.g., gas and/or other fluid), defined by an outer surface of the mandrel 340 and an inner surface of the casing 335, via a gas lift valve 360 disposed in the pocket 350. For example, the gas lift valve 360 may be disposed in the pocket 350 where a portion of the gas lift valve 360 is in fluid communication with an annulus (e.g., with casing fluid) and where a portion of the gas lift valve 360 is in fluid communication with a lumen (e.g., with tubing fluid). In such an example, fluid may flow from the annulus to the lumen (e.g., bore) to assist with lift of fluid in the lumen or, for example, fluid may flow from the lumen to the annulus. The pocket 350 may include an opening that may be oriented downhole and one or more openings that may be oriented in a pocket wall, for example, directed radially to a lumen space. As an example, the pocket 350 may include a production conduit lumen side opening (e.g., an axial opening) for placement, retrieval, replacement, adjustment, etc. of a gas lift valve. For example, through use of a tool, the gas lift valve 360 may be accessed. As an example, where a gas lift valve includes circuitry such as a battery or batteries, a tool may optionally provide for charging and/or replacement of a battery or batteries.

In the example of FIG. 3, gas is illustrated as entering from the annulus to the gas lift valve 360 as disposed in the pocket 350. Such gas can exit at a downhole end of the gas lift valve 360 where the gas can assist in lifting fluid in the lumen of the mandrel 340 (e.g., as supplied via a bore of production tubing, etc.).

As an example, a side pocket mandrel may be configured with particular dimensions, for example, according to one or more dimensions of commercially available equipment. As an example, a side pocket mandrel may be defined in part by a tubing dimension (e.g., tubing size). For example, consider tubing sizes of about 2.375 in (e.g., about 60 mm), of about 2.875 in (e.g., about 73 mm) and of about 3.5 in (e.g., about 89 mm). As to types of valves that may be suitable for installation in a side pocket mandrel, consider dummy valves, shear orifice valves, circulating valves, chemical injection valves and waterflood flow regulator valves. As an example, a side pocket may include a bore configured for receipt of a device that includes an outer diameter of about 1 in. (e.g., about 25 mm), or about 1.5 in. (e.g., about 37 mm) or more. As mentioned, a running tool, a pulling tool, a kickover tool, etc. may be used for purposes of installation, retrieval, adjustment, etc. of a device with respect to a side pocket. As an example, a tool may be positionable via a slickline technique.

As an example, a side pocket mandrel may include a circular and/or an oval cross-sectional profile (e.g., or other shaped profile). As an example, a side pocket mandrel may include an exhaust port (e.g., at a downhole end of a side pocket).

As an example, a mandrel may be fit with a gas lift valve that may be, for example, a valve according to one or more specifications, such as an injection pressure-operated (IPO) valve specification. As an example, a positive-sealing check valve may be used such as a valve qualified to meet API-19G1 and G2 industry standards and pressure barrier qualifications. For example, with a test pressure rating of about 10,000 psi (e.g., about 69,000 kPa), a valve may form a metal-to-metal barrier between production tubing and a casing annulus that may help to avoid undesired communication (e.g., or reverse flow) and to help mitigate risks associated with gas lift valve check systems.

Figure 4:
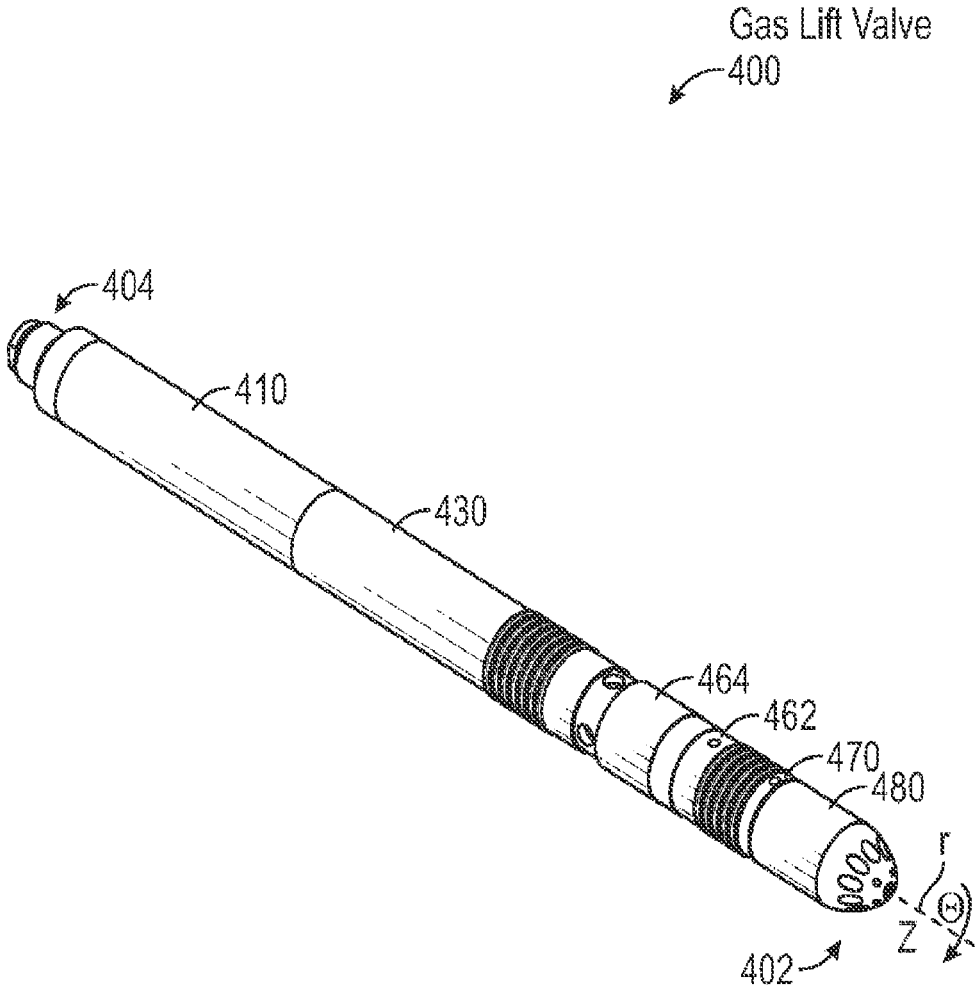
FIG. 4 illustrates an example of a gas lift valve.

FIG. 4 shows an example of a gas lift valve 400 that includes a gas outlet end 402, a tool end 404, a control gas chamber section 410, a bellows valve mechanism section 430, a coupling 462, a gas inlet section 464, a coupling 470 and a gas outlet section 480. Various features of the gas lift valve 400 may be described with respect to a cylindrical coordinate system (e.g., r, z, Θ) where, for example, a z-axis represents a longitudinal axis of the gas lift valve 400, a r-axis represents a distance from the z-axis (e.g., radially outwardly) and an azimuthal angle (Θ) represents an azimuthal position of a feature, for example, with respect to a feature that may be deemed to be at 0 degrees (e.g., a reference feature such as an opening, etc.).

In the example of FIG. 4, the gas lift valve 400 can include a plurality of seal elements, for example, to seal against a bore of a mandrel in which at least a portion of the gas lift valve 400 may be disposed. As an example, a seal element or seal elements may act to form a seal between an outer surface of a gas lift valve and an inner surface of a bore of a mandrel where such a seal may be disposed between a gas inlet opening and a gas outlet opening of the gas lift valve. As an example, seal elements may be ring shaped and, for example, at least in part seated in one or more annular grooves of an outer surface of a gas lift valve. As an example, a gas lift valve can include a plurality of internal seal elements.

Figure 5A:
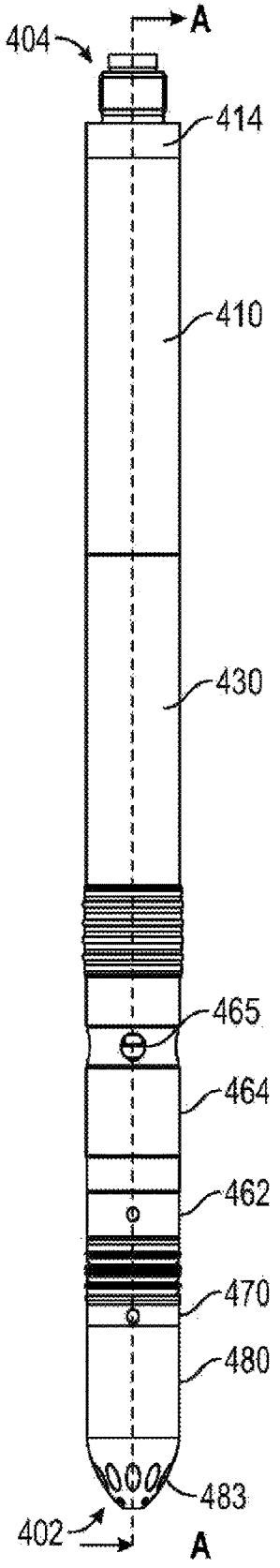
FIGS. 5A and 5B illustrate the gas lift valve of FIG. 4.
Figure 5B:
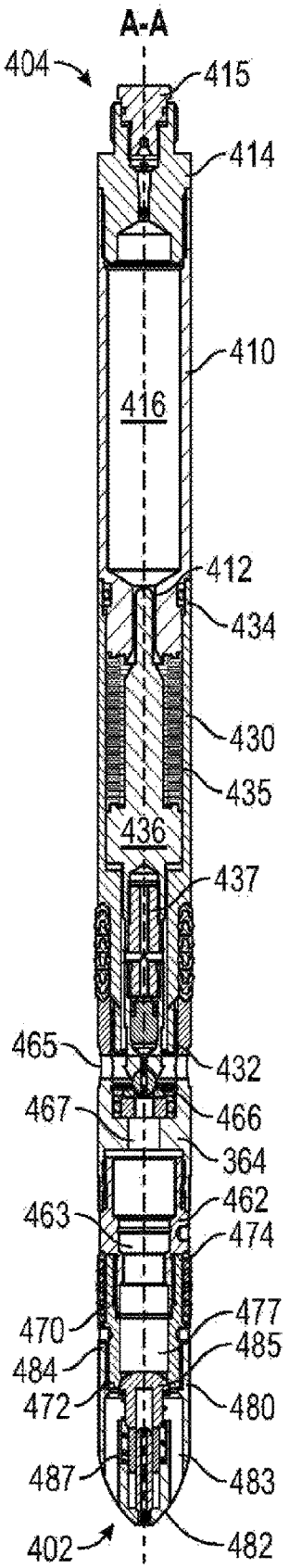

FIG. 5A shows a side view of the gas lift valve 400 and FIG. 5B shows a cutaway view of the gas lift valve 400 along a line A-A. As shown in FIG. 5A, the gas inlet section 464 includes at least one opening 465 as a gas inlet (see, e.g., the arrangement of FIG. 3) and the gas outlet section 480 includes at least one opening 483 as a gas outlet.

FIG. 5B shows the control gas chamber section 410 as including a piston bore 412 and a plug 414 at opposing ends of a gas chamber 416, which may be charged with gas such as nitrogen. In the example of FIG. 5B, a seal plug 415 may be utilized to seal a passage in the plug 414, for example, after charging the gas chamber 416 to a desired gas pressure.

FIG. 5B shows the bellows valve mechanism section 430 as including opposing ends 432 and 434, a bellows 435, a piston 436 and a valve member 437. In the example of FIG. 4B, the bellows 435 may be sealed with respect to the bellows 435 and the chamber 416. In such an example, the one or more openings 465 of the gas inlet section 464 can communicate gas pressure that can act upon the valve member 437. In such an example, where the pressure is sufficiently high (e.g., with respect to pressure in the chamber 416), force exerted may cause the valve member 437 and the piston 436 to translate toward the chamber 416. In such an example, the valve member 437 may retract from a valve seat 466 that is supported by the gas inlet section 464. As shown, the valve seat 466 is annular such that an opening defined thereby can allow for flow of gas to a bore 467 of the gas inlet section 464.

In the example of FIG. 5B, the coupling 462 includes a bore 463 that is in fluid communication with the bore 467 and that is in fluid communication with a bore 477 of the coupling 470 such that gas pressure can act upon a check valve member 485 supported by the gas outlet section 480, which may be seated against an end 472 of the coupling 470, which has an opposing end 474. For example, the check valve member 485 may include a translatable dome shape that can seat against an annular check valve seat defined by the end 472 of the coupling 470.

In the example of FIG. 5B, the check valve member 485 can be biased by a biasing member 487, which may be, for example, a spring. Where gas pressure in the bore 477 of the coupling 470 is sufficiently high, force acting on the check valve member 485 may cause compression of the biasing member 487 and translation of the check valve member 485 downwardly away from the gas inlet section 464 such that the one or more openings 465 of the gas inlet section 464 become in fluid communication with the one or more openings 483 of the gas outlet section 480.

As an example, the check valve member 485 may be referred to as a dart. As an example, the check valve member 485 may be considered to be a low-pressure valve member; whereas, the valve member 437 may be considered to be a high-pressure valve member. As an example, a valve member can include a ball that can be seated in a valve seat to plug an opening in the valve seat.

As explained, fluid can flow in various types of equipment, which may include one or more fluid passages, which may range in a cross-section dimension from 0.1 cm to 30 cm (e.g., consider a diameter of 0.1 cm to a diameter of 30 cm). Scale formation in a fluid passage can be detrimental to one or more operations, which may include equipment operation (e.g., gas lift valve, etc.) to production operation (e.g., production of hydrocarbons, etc.). Scale buildup can render equipment inoperable and costly to remediate or remove. As mentioned, scale building in side-pocket mandrel can be detrimental, where scale formed may diminish cross-section of a passage (e.g., a tool passage, a fluid passage, etc.). In various instances, one or more operations may be performed that aim to mitigate scale, treat scale, etc.

As an example, a method can provide a robust data-driven approach for continuous gas-lift optimization where a well response can be noisy (e.g., include noise). Such a method may be for one or more wells where, for example, available gas may be considered (e.g., an available gas limit). Such a method can provide for improved gas-lift optimization in presence of a noisy response to provide for appropriate resource allocations, for example, with respect to one or more expected values. As an example, a method may optionally account for one or more phenomena such as scaling, equipment wear, etc. For example, output from an optimization method may be integrated into a more expansive plan for field operations.

As an example, a method can operate according to constraints and a control scheme or schemes where field data as acquired by one or more sensors may be utilized. As an example, a method may be applied to a single well or may be applied to multiple wells (e.g., a multi-well method). Various trials results are presented, for example, for a single well with noise and excess gas, multiple wells with noise and excess gas, multiple wells with noise and a gas limit, multiple wells without noise and excess gas and multiple wells without noise and a gas limit.

As an example, a method can be or include a control scheme that can handle noisy well responses with consideration of changing well behavior with time. As explained further below, a method can handle various two-well cases with excess or limited lift-gas with either noisy or smooth underlying representative gas-lift performance curves. Various trial results demonstrate the efficacy of various example methods in handling noisy responses over multiple wells, for example, with an aim to maximize long-term expected value of production (e.g., in place of a single optimum that may be hard to attain).

As an example, a sequence of polynomial representations may be constructed for a single noisy well or for multiple noisy wells. In such an example, a resulting distribution of solution set points can be derived. Such a method can aim to maximize the long-term expected value of the well response.

Figure 6:
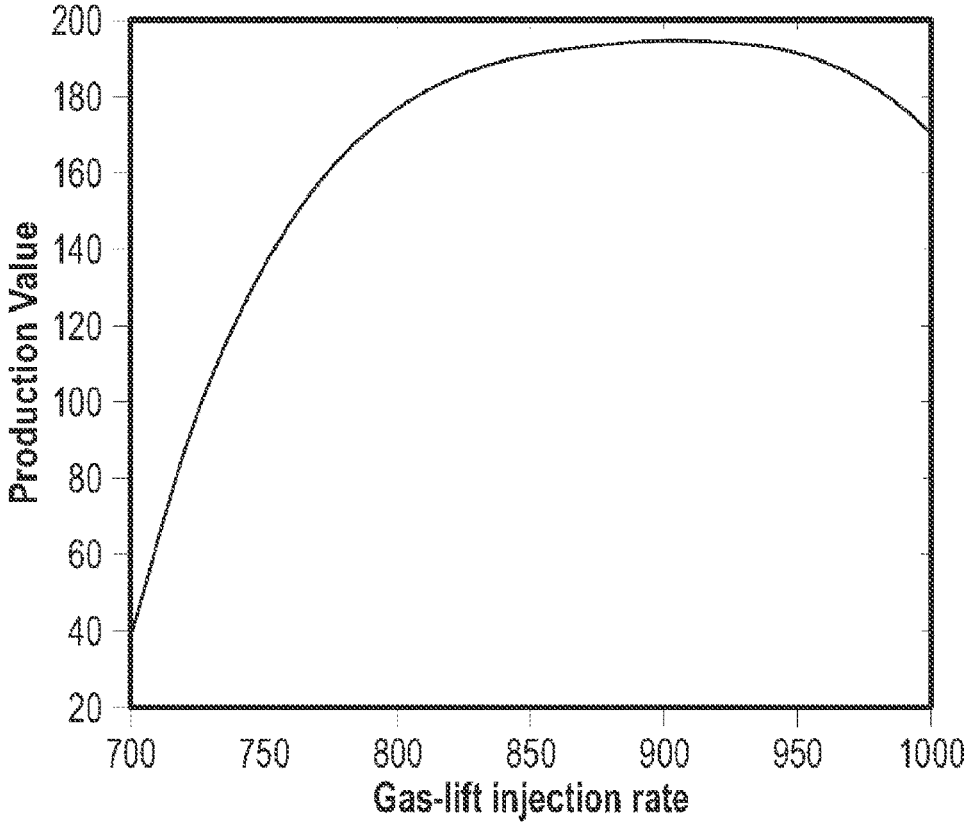
FIG. 6 illustrates examples of plots.
Figure 6:
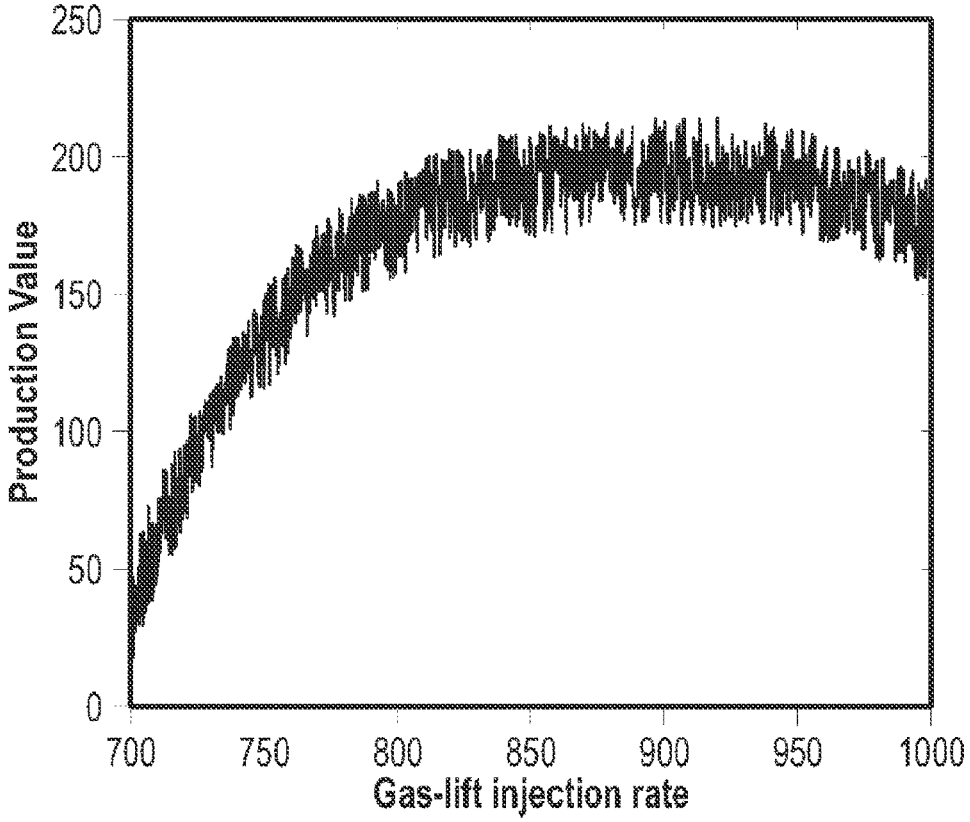

Continuous gas-lift optimization concerns the distribution of lift gas over one or more wells. Allocated gas can be injected at high pressure into the annulus of a wellbore, which can facilitate lifting fluid upwardly, for example, where increased gas quantity in the wellbore can reduce pressure exerted by a column of fluid. Such phenomena can lower the bottom-hole pressure and assists in pushing more fluids to the surface. Often, each well has a desirable lift gas-rate that improves well production, beyond which the production rate is impaired by the increased frictional losses resulting from excessive gas injection. Thus, a gas-lift performance curve (GLPC) takes a form as shown in FIG. 6 (top).

Gas-lift optimization thus concerns the optimal distribution of available lift-gas under specified operational constraints so as to maximize the value of the produced hydrocarbons over all wells. Two approaches used to tackle this problem can be categorized as either simulation model-based or model-free.

In a simulation-based approach, each well may be modeled using data concerning trajectory, dimensions, fluid properties, reservoir pressure, temperature, and other pertinent information, including the surface network connecting the wells. The simulation model can then be optimized to provide the gas-lift rates that maximize the total value subject to operational constraints, including those that dictate flow assurance by prevention of hydrate, wax or asphaltene formation, in one step.

In a data driven (model-free) approach, pertinent data gathered directly at the well-site that describes the production value of each well as a function of gas lift injection is used to provision information that can be applied to a controller to furnish a new set point over all wells. Such an approach can proceed without simulation model construction, validation, or maintenance and without modeling assumptions where errors are not introduced.

The data driven (model-free) approach has the advantage of providing a predictive response that can be used for optimization purposes directly in conjunction with a suitable solver. The model-free approach can involve a sequence of iterates, that step towards system optimality. Thus, the simulation-based approach requires time and effort to develop a reliable simulation model, while the data driven (model free) approach demands time to physically iterate the real-system towards optimality in closed-loop.

Simple curve-based representations, nodal analysis or detailed simulation responses to solve the continuous gas-lift optimization problem are described in [Beggs, H. D., *Production Optimization using Nodal Analysis*, OCGI Publishing, 2008, Rashid, K., An Optimal Allocation Procedure for Gas-Lift Optimization', J. of Industrial and Engineering Chemistry Research, 49, no. 5, pp. 2286-2294, 2010 and Rashid, K., Bailey, W. J. and Couet, B., Review Article: A Survey of Methods for Gas Lift Optimization', J. of Modeling and Simulation in Engineering, Hindawi Publishing Corp, Vol. 2012, Article ID 516807, September 2012]. However, in these model-based schemes, the implicit assumption is that the representative gas-lift performance curve (GLPC) is smooth and well-behaved [See United States Patent Publication No.: 2021-0198988]. In a model-free approach, real-time data is gathered from multi-phase flow meters. The data are noisy and prone to variation due to several complicating factors. These include the set-point control (which is often specified in a band of the setting), data acquisition (compounded by hardware and sensor noise), data quality (processing and filtering methods), well stability (inherent dynamics due to flow regime, interdependent wells and back-pressure effects imposed by connected pipelines), equipment failure (downtime in compression and data acquisition), among others. The net result is the well response is not smooth and stable, but rather, is replete with noise and variation as shown in FIG. 6 (bottom).

As explained, a robust method for gas-lift optimization can effectively optimize a system of wells using a real-time data-driven approach where such a method can be model-free.

A general problem can be stated as follows:

$$\max F(X) = \sum_{i=1}^{n} f_i(x_i) \quad (1)$$

$$\text{s.t } G(X) \le 0$$

$$x_i \ge 0 \forall\, i \in [1 \quad n]$$

where the objective F(X) is based on the collective measure from each well $f_i(x_i)$ defined as:

$$f_i(x_i) = v_i q_i(x_i \mid P_i) - k_g x_i \quad (2)$$

Above, $q_i(x_i|P_i)$ is a representative model of the i-th well under parameterization $P_i$, and $v_i$ is the production value given by:

$$v_i = [p_o(1-\alpha_i) + p_g\beta_i(1-\alpha_i) - k_w\alpha_i] \quad (3)$$

where $\alpha_i$ and $\beta_i$ are the water-cut and gas-oil-ratio estimates. $p_o$ and $p_g$ are the unit oil and gas production values, respectively, while $k_w$ and $k_g$ are the unit produced water disposal and gas injection cost, respectively. Note that if $p_g$, $k_w$ and $k_g$ are set to zero and $p_o$ is set to one, the oil rate is obtained. If $\alpha_i$ is also set to zero, the liquid rate is obtained. Hence, the value-based measure can be specified as desired.

A set of constraints G(X) concern the available lift gas, the injection rate bounds for each well, together with well and field level rate constraints (given fluid properties $\alpha_i$ and $\beta_i$). This results in a set of (m=5+6n) constraints, given in standard form, $G_j(X) \leq 0$ for $j \in [1, m]$, as follows:

$$(1)\sum_{i=1}^{n} x_i - C \leq 0 \tag{4}$$

$$(1)\sum_{i=1}^{n} q_i - B_l \leq 0 \tag{5}$$

$$(1)\sum_{i=1}^{n} q_{oi} - B_o \leq 0 \tag{6}$$

$$(1)\sum_{i=1}^{n} q_{wi} - B_w \leq 0 \tag{7}$$

$$(1)\sum_{i=1}^{n} q_{gi} - B_g \leq 0 \tag{8}$$

$$(n)q_i(x_i) - B_{li} \leq 0 \tag{9}$$

$$(n)q_{oi}(x_i) - B_{oi} \leq 0 \tag{10}$$

$$(n)q_{wi}(x_i) - B_{wi} \leq 0 \tag{11}$$

$$(n)q_{gi}(x_i) - B_{gi} \leq 0 \tag{12}$$

$$(n)L_i - x_i \leq 0 \tag{13}$$

$$(n)x_i - U_i \leq 0 \tag{14}$$

where the number of equations expected for each type is given in brackets, C is the available gas limit, and $B_l$, $B_o$, $B_w$ and $B_g$ are the stipulated cumulative liquid, oil, water and gas rate limits, respectively. The well limits by phase are similarly asserted with index i, including the lower and upper bounds given by $L_i$ and $U_i$, respectively.

One additional constraint may impose a restriction on the step size change from the current operating point, $X_o$. This can help to ensure that any new solution will be within a trust region of the current point. The nonlinear inequality constraint is specified as follows:

$$\|X, X_o\| \leq d_{max} \tag{15}$$

where $d_{max}$ is the step length limit.

Thus, a set of m=6+6n constraints may be stated by default for a system with n wells, given compactly as $G(X) \leq 0$. Unnecessary constraints can be deactivated by setting the associated right-hand side terms to infinity, and the addition of other constraints is not precluded. The problem (1) can be solved with a suitable nonlinear constrained solver [Boyd, S. and Vandenberghe, L., Convex Optimization, Cambridge University Press, 2004 and IPOPT Solver, Computational Infrastructure for Operational Research, Reference Guide, www.coin-or.org].

As an example, a high level control scheme can manage a solution procedure (e.g., as above). A schema described in CONTROL SCHEME may encounter certain difficulties in practical application, as elaborated below.

Firstly, assume that a desired set point is given by $x_{new} \in R^n$. The required set point, stipulated as X, is implemented in the field by closed-loop actuation. A stabilization period $T_1$ and an equilibrium period $T_2$ are elapsed (in the order of hours) before two conditions are evaluated on the gathered real-time meter data. The first C1, concerns an up-time requirement on the gas set point (for each well), while the second C2 concerns an up-time requirement on the flow meter data (from each well). The first condition confirms that the desired set-point was actually implemented, while the second ensures that the meter is gathering data from a producing well. If either condition is unmet, a given wait time $t_w$ is elapsed before the conditions are re-tested. If C1 and C2 are both met, the effective flowrate measurements are established. These are recorded in a dataset D and provided as input to the SOLVER. The method will return a new set point stemming from a sample generation step if the sample size remains below the size $m_r$, or else obtained as the solution to the problem of the last section.

Method: Control Scheme

Input: $x_{new}$.
Set $X=x_{new}$
Implement set point X in the field.
Wait for stabilization period $T_1$.
Wait for equilibrium period $T_2$.
Check conditions C1 and C2—Set-point and Meter up-time requirement.
If C1 or C2→FAIL:
Wait for delay period $t_w$.
Return to check conditions C1 and C2.
Else:
Establish flowrate readings.
Store set point and flowrate data in D.
Get size of data D→m.
If m<mr:
Call SAMPLE→$x_{new}$.
Else:
Call SOLVER→$x_{new}$.
If STOP condition is FALSE: Repeat.
Else: Stop.
Output: Set of samples D, distribution $X \in R^n$, expected value over $Y \in R^n$.

In various situations, it may be expected that the conditions C1 and C2 will be met for a working system. Failure to meet these conditions over a given period can be indicative of a fault that may demand investigation. As an example, a failure to meet one or more criteria may be utilized as part of issue detection and/or notification. As explained, a result of a regression may be utilized, measurements may be utilized and/or one or more criteria may be utilized, optionally via one or more trained machine learning models (e.g., consider TENSORFLOW, scikit-learn, etc.).

As indicated by the control scheme in the last section, an effective flow rate measure can be demanded (e.g., received, acquired, etc.) for each well once the stabilization and equilibrium periods have elapsed. However, this can be fraught with difficulty due to reliability, quality and interpretation of the noisy data gathered from the well-site.

Figure 7:
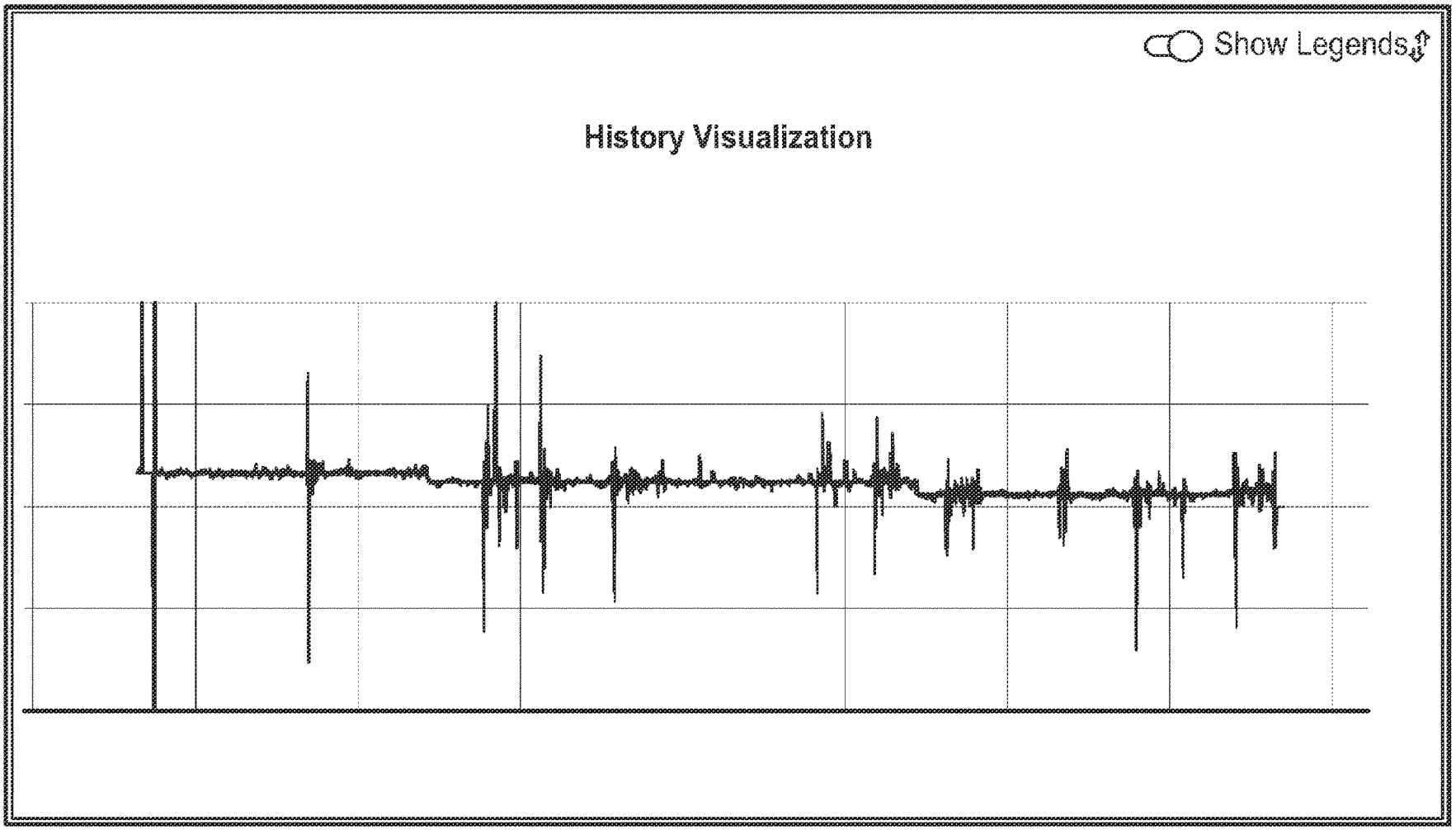
FIG. 7 illustrates an example of a graphical user interface.

FIG. 7 shows an example of a graphical user interface (GUI) of a computational system where an example of a set point profile as a function of time is shown. Such information may be obtained from a real-time data acquisition system (e.g., Schlumberger Agora) in conjunction with on-site multi-phase flow meters (e.g., Schlumberger Vx). The darker line indicates the desired set point for a given well. The lighter oscillating line indicates the rate set point reading. That is, the actual set-point implemented in practice using the hardware infrastructure available at the well-site. The erratic readings indicate that the actual set point varies around the stipulated set point value. This is a hardware and control artifact but is a source of noise in the well response.

In particular, FIG. 7 shows real-time well gas injection rate—desired set-point (darker color) and actual set-point (lighter color).

Figure 8:
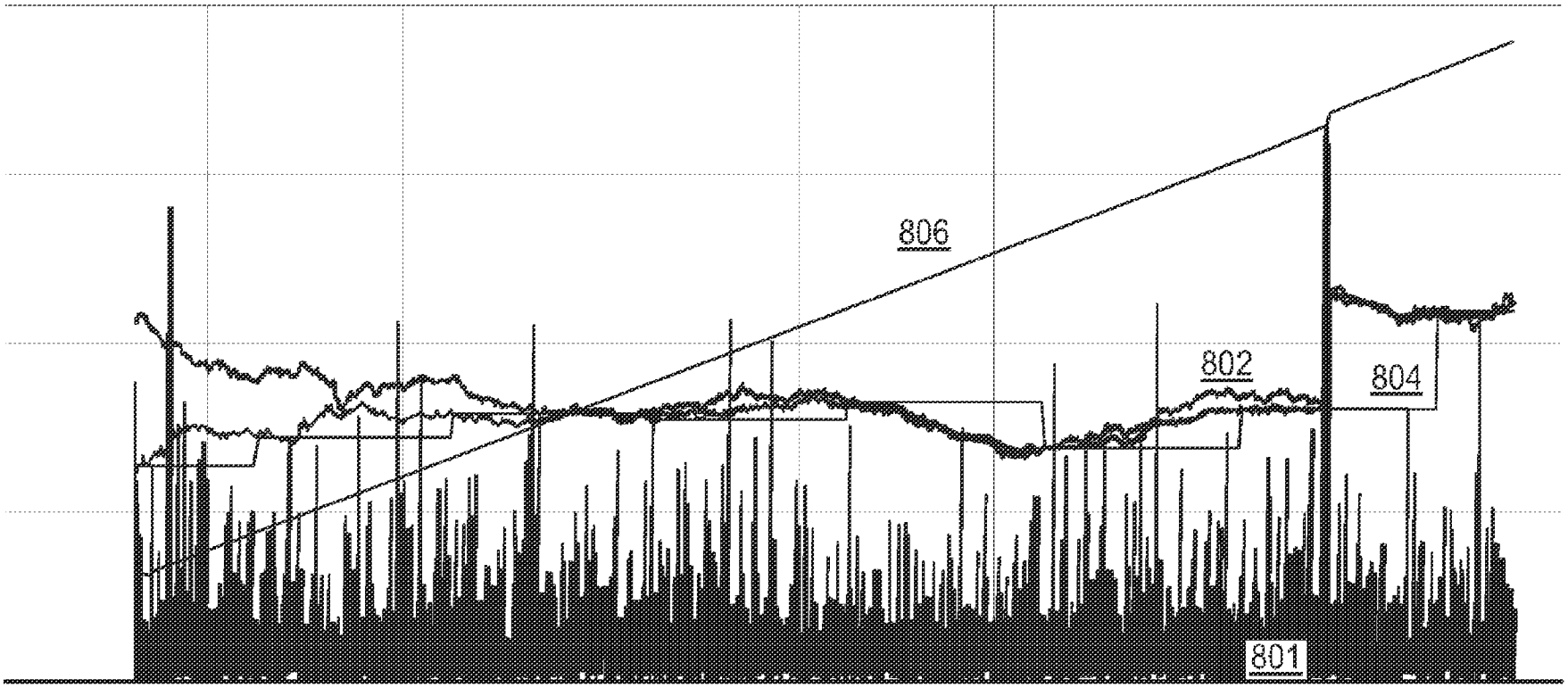
FIG. 8 illustrates an example of a graphical user interface.

FIG. 8 shows a GUI with well flowrate readings. Four evaluation data streams are shown. The line (801) shows the instantaneous Vx meter readings. The line (802) shows a moving average measure of the cumulative rate over the last 24 hours. The line (804) shows a daily mean and the sloping line (806) is the cumulative Vx rate record. A reliable and accurate reading demands that the gas-lift set-point was actively achieved (condition C1) and that sensible meter data was gathered over the equilibrium period from a producing well (condition C2). Data can be filtered, smoothed, and interpreted effectively to get the flow-rate measure for the well. The source of noise withstanding, the proposed method is robust to handle the variability in the well response. As to FIG. 8, it shows real-time well flow rate streams—spot rate (801), cumulative (806), moving average (802) and daily average (804).

Below, single well example methods are described and then various methods for one or more multi-well schemes are discussed.

Single Well Procedure

Consider a single well that is to be optimized for gas-lift injection. Let the underlying GLPC be described as shown in FIG. 6 (bottom). This is effectively the GLPC shown in FIG. 6 (top) with the addition of a uniform noise level. Thus, FIG. 6 (bottom) is one example of the GLPC with a sample taken at each gas-lift rate. A subsequent sampling will give a similar, but different profile due to the random noise.

The single well problem can be stated as:

$$\max F(x) \quad \text{s.t. } x \in R \quad x_L \le x \le x_U \tag{16}$$

where x is the gas-lift injection rate, F(x) is resulting production value from the well with set-point x and bounds $x_L$ and $x_U$, respectively.

The procedure may be applied as follows:

Firstly, let the dataset $D \in R^{m \times 2}$ represent a collection of m samples of the production value with a given gas-lift injection rate that may have been collected from past trials, separator tests, or the like. If D is empty, the current operating point can be inserted and a new trial generated by perturbation, random step update or in a sequence as per a step rate test. The intent is to populate the dataset D with m samples that are recent, reliable, and indicative of the well behavior with the gas-lift injection rate x.

Once the number of samples reaches the minimum desired number ($m_s$), the procedure can be applied as per the schema labeled MAIN.

The input parameters to MAIN include the gas lift bounds, $x_L$ and $x_U$, the minimum sample x-span length $s_{min}$, the number of retained samples $m_r$ and the number of iterations $n_p$. X and Y are the collection of gas-lift rates x and the associated responses y. $X_L$ and $X_R$ indicate the left and right-side anchor points, respectively, with lower bound on response value given by $\bar{y}_L$ and $\bar{y}_R$, respectively. The method sets the retained sample set S and the routine NEW SAMPLE returns the next sample of interest $x_{new}$. This value is implemented in the field as a set-point. After the equilibrium period ($T_2$), following the stabilization period ($T_1$), the updated well response ($y_{new}$) is returned. X, Y, D and S are all updated, along with the anchor points with revised lower bounds. A check is made on the inclusion of the lower and upper values in the retained set. If the sample exists, it replaces the associated anchor point and updates the lower bound value accordingly. The procedure repeats in this manner for the designated number of iterations $n_p$. Once completed, the routine returns the distribution of set-points in X and the expected value over the set of responses in Y.

Method: Main

Input: $x_L$, $x_U$, $s_{min} \in R$ and $m_r$, $n_p \in N$
Initialize X and Y as Ø.
Initialize $X_L$ and $X_R$ as Ø.
Initialize $\bar{y}_L$ and $\bar{y}_R$ as ∞.
Set resident sample size, $m=m_r$.
Extract retained set $S \in R^{m \times 2}$ from dataset D.
For each iteration: k=1 to $n_p$
NEW SAMPLE ($x_L$, $x_U$, $s_{min}$, $X_L$, $X_R$, S)→$x_{new}$, $y_L$ and $y_R$.
Implement set point as $x_{new}$.
Get response from well $y(x_{new})$.
Update $X=X \cap x_{new}$.
Update $Y=Y \cap y_{new}$.
Set new sample s=[x y].
Update dataset $D=D \cap s$.
Update retained set $S \in R^{m \times 2}$ given dataset D.
If ($y_L>0$) and ($y_L<\bar{y}_L$):
Update $\bar{y}_L=y_L$
Update LHS anchor point: $X_L=[x_L\ \bar{y}_L]$.
If ($y_R>0$) and ($y_R<\bar{y}_R$)
Update $\bar{y}_R=y_R$
Update RHS anchor point: $X_R=[x_U\ \bar{y}_R]$.
Check if $x_L$ is in S→$f_L$, $S_L$
Check if $x_U$ is in S→$f_R$, $S_R$
If $f_L$:
Update $X_L=S_L$
Set $\bar{y}_L=S_L[y]$.
If $f_R$:
Update $X_R=S_R$,
Set $\bar{y}_R=S_R[y]$.
Increment counter k=k+1
Repeat if $k \le n_p$
Plot distribution of samples in X
Establish expected value $$V = E[Y] = \frac{1}{m}\sum Y$$

Output: X, Y and V.

The routine NEW SAMPLE checks if the anchor points $X_L$ and $X_R$ are specified. If so, the points are added as samples to the retained set S and the number of anchor points $n_c$ is incremented accordingly. Then, using the original sample set, the span and best-known sample point are established. The POLYNOMIAL SOLUTION procedure is employed to best fit the set of retained data. The method returns the optimal set of polynomial coefficients $\hat{P}$ as well as the functional responses at the lower and upper gas lift values, respectively, that serve to identify the anchor points. If the minimum span size requirement ($s_{min}$) is not met, a span extension point is generated using the SPAN EXTENSION procedure. If the suggested new sample already exists in the original sample set, it is replaced by a perturbed solution using the method PERTURB SOLUTION. The NEW SAMPLE method returns a new sample of interest $x_{new}$ as required, along with the polynomial fit coefficients $\hat{P}$ and the function values at the lower and upper values ($x_L$ and $x_U$) respectively.

Method: New Sample

Input: $x_L$, $x_U$, $s_{min}$, $X_L$, $X_R$ and S.
Copy original sample set $S_0$=S
Initialize anchor point count $n_c$=0
If $X_L\exists$:
Update S=S $\cap X_L$ and increment $n_c$.
If $X_R\exists$:
Update S=S$\cap X_R$ and increment $n_c$.
Get $x_{span}$, $x_{best}$, $y_{best}$ Of $S_0$:
Get $x_1$=min $S_0$ [x].
Get $x_2$=max $S_0$ [x].
Get $y_{best}$, yind=max $S_0$ [y].
Get $x_{best}$=$S_0$ [yind][x].
Set $x_{span}$=$x_2$−$x_1$.
Set update type $n_t$=1.
POLYNOMIAL SOLUTION ($x_L$, $x_U$, $n_c$, S)→$\hat{P}$, $x_{new}$, $y_L$, $y_R$.
If ($x_{span}\leq s_{min}$):
SPAN EXTENSION ($x_L$, $x_U$, $s_{min}$, $S_0$)→$x_{new}$.
Set $n_t$=2.
Check if $x_{new}$ is in $S_0$→$f_T$, $S_T$.
If ($f_T$):
PERTURB SOLUTION($x_{best}$, $s_{min}$)→$x_{new}$.
Set $n_t$=3.
Output: $x_{new}$, $y_L$, $y_R$, $\hat{P}$ and $n_t$.

The method SPAN EXTENSION establishes the span extension requirement $x_d$ (the extent required to meet the span condition $s_{min}$). The left and right-side samples are estimated and one is selected based on sample feasibility. The method returns a span extension point $x_{new}$.

Method: SPAN EXTENSION

Input: $x_L$, $x_U$, $s_{min}$ and $S_0$.
Get size of S→m.
Get $x_{min}$=min $S_0$ [x].
Get $x_{max}$=max $S_0$ [x].
Establish $x_{span}$=$x_{max}$−$x_{min}$
Establish $x_d$=$s_{min}$−$x_{span}$
Set $x_1$=$x_{min}$−$x_d$→LHS extension point
Set $x_2$=$x_{max}$+$x_d$→RHS extension point
Initialize $x_1^{feas}$=$x_2^{feas}$=F.
If $x_L\leq x_1\leq x_U$: $x_1^{feas}$ is T.
If $x_L\leq x_2\leq x_U$: $x_2^{feas}$ is T.
If ($x_1^{feas}$) and ($x_2^{feas}$=F):
Set $x_{new}$=$x_1$.
If ($x_2^{feas}$) and ($x_1^{feas}$=F):
Set $x_{new}$=$x_2$.
If ($x_2^{feas}$) and ($x_1^{feas}$):
Randomly pick ($x_1$ or $x_2$)→$x_{new}$.
Output: $x_{new}\in$ R.

The method POLYNOMIAL SOLUTION solves a regression problem to fit the best polynomial of size p so as to minimize the sum of residual errors of the samples in S given by the root-mean-square-error (RMSE) measure. If anchor points are included in the dataset, with $n_c$>0, a weighted error measure is used where the anchor point samples have a greater weight assignment. The argument that maximizes the best polynomial ($\hat{P}$) is returned as the new set point, along with the left and right-side functional values that are used to revise the anchor points.

The PERTURB SOLUTION method provides a perturbed set point around the best-known sample as needed.

Method: Polynomial Solution

Input: $x_L$, $x_U$, $n_c$, S
solve: $\text{argmin}_P\Omega(P|S)\rightarrow\hat{P}$.

with:

$$\Omega(P\mid S)=\sqrt{\left(\frac{1}{m}\sum_{j=1}^{m}\left(S[y]-y_j^{pred}\right)^2\right.},$$

with:

$$\Omega(P\mid S)=\sqrt{\left(\frac{1}{\sum w_j}\sum_{j=1}^{m}w_j\left(S[y]-y_j^{pred}\right)^2\right.},$$

if $n_c\geq 0$.

where $$y_j^{pred}=F(x_j\mid P)=\sum_{k=0}^{p}P_kx_j^k.$$

Set $$x_{new}=\text{argmin}_xF(x\mid\hat{P})=\sum_{k=0}^{p}\hat{P}_kx^k.$$

Establish $y_{pred}$=F($x_{new}$|$\hat{P}$).
Establish $y_L$=F($x_L$|$\hat{P}$).
Establish $y_U$=F($x_U$|$\hat{P}$).
Output: $x_{new}$, $y_L$ and $y_R$.

Method: Perturb Solution

Input: $x_{ref}$, $s_{min}$.
Initialize $\alpha$=0.1 and $\tau$=1.
Set $\beta$=uniform random variable [0 1].
If $\beta\geq 0.5$: set $\tau$=−1.
Set $x_{new}$=$x_{ref}$+$\tau\alpha\beta s_{min}$.
Output: $x_{new}$.

Multi-Well Procedure

A general gas-lift optimization problem over n wells can be stated as follows:

$$\max F(X) \quad \text{s.t. } X\in R^n,\quad X_L\leq X\leq X_U \tag{17}$$

where X is the set of gas-lift injection rates, F(X) is resulting production value over all n wells, with bounds $X_L$ and $X_U$ ($\in R^n$), respectively. The proposed method can be applied as described previously for a single well, but with some differences.

First, in order to populate the initial data set D, a number of deterministic, or otherwise, randomly perturbed trials can be performed over n-dimensional space. The aim is to collect m recent samples that are indicative of the well responses with gas injection rate $X\in R^n$. The data set can store the responses $Y\in R^n$ as well as the cumulative measure F(X).

The MAIN procedure can then be applied as described above, but with the elements extended as n-dimensional vectors where necessary. For example, the revised NEW SAMPLE method (NEW SAMPLE MOD) will return $x_{new}\in R^n$ and the anchor points are managed over all n wells accordingly. Thus, while the purpose of NEW SAMPLE MOD is unchanged, the implementation manages data over all wells. The retained data set S is devised for each well and an associated polynomial model is constructed using NEW SAMPLE, as previously. However, instead of returning the optimum of each representation directly, an optimization problem is solved that yields the optimal distribution of lift gas over all wells subject to imposed constraints. Thus, $x_{new}$ is now the result of an optimization problem.

Note that some considerations are necessary to manage span or perturbed well outcomes. Either those wells can be omitted from the optimization step with an associated reduction in the available lift gas, or the well may be retained with a fixed injection rate stipulation (i.e., $x_i=x_i^L=x_i^U$).

The methods SPAN EXTENSION, PERTURB SOLUTION and POLYNOMIAL SOLUTION remain unchanged. The modified method NEW SAMPLE MOD is listed below for clarity (where the blue labels represent the n-dimensional equivalent containers).

Method: New Sample Mod

Input: $x_L$, $x_U$, $s_{min}$, $X_L$, $X_R$ and S overall n wells.

Get number of wells→n.

For k=1 to n

Set by well: $x_L$, $x_U$, $X_L$, $X_R$ and S.

Call NEW SAMPLE→x, $y_L$, $y_R$, P and $n_t$ for well k.

Store x, $y_L$, $y_R$, P and $n_t$.

Solve max $\bar{F}(X|\text{blueP})\rightarrow\hat{X}$

Set $x_{new}=\hat{X}$.

Output: $x_{new}$, $y_L$, $y_R$, P, $n_t$ overall n wells.

Demonstrative results for various single and dual well cases are presented in the next section.

Examples of Trial Results

Results for various test cases are presented in this section.

Single Well—Case 1—Noisy—Excess Gas

Figure 9:
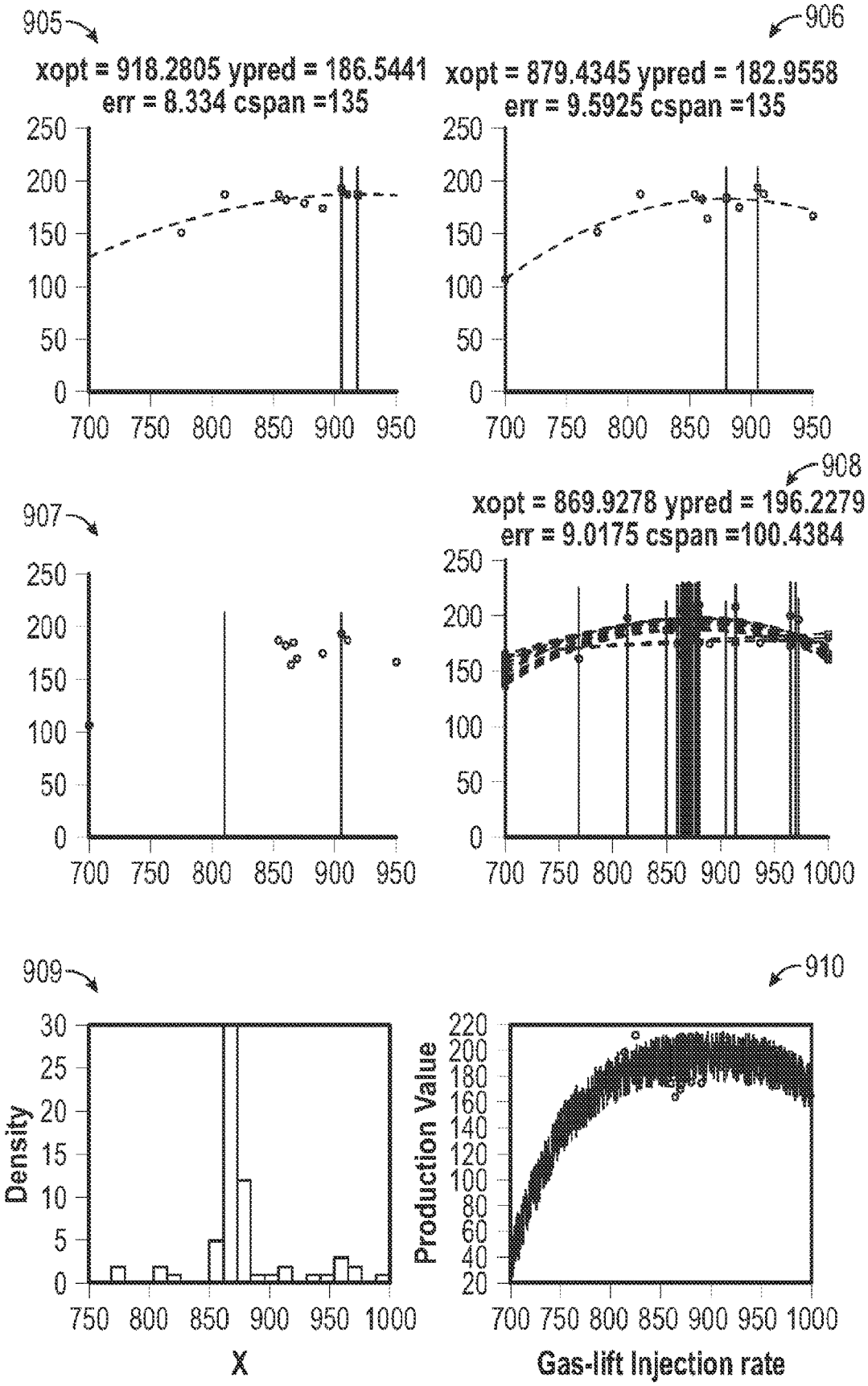
FIG. 9 illustrates examples of plots.

FIG. 9 shows plots 905, 906, 907, 908 and 910. The plot 905 shows eight retained samples (circles) and the best-known sample is marked by the vertical line. The solution for a second order polynomial (p=2) is shown by the dotted line with the condition that $p_2<0$. This ensures that the polynomial has a desired convex-down form. The optimal solution on the fitted polynomial is marked by the star and line 911. In this example, $x_{opt}$ is 918.3 with a predicted response $y_{pred}$ of 185.5. The error measure (mismatch to known samples) is 8.33 and the span length 135 exceeds the minimum condition $s_{min}=50$.

The plot 906 is an example of a different set of eight samples, but with the addition of two anchor points. The best fitted polynomial is shown as the dotted line, with the optimum at [879.4 183.0]. The best-known sample is marked by the vertical line 912. This is an example of the polynomial design step with a weighted error measure when anchor points are specified.

The plot 907 shows that the span condition is not met by the set of eight retained points. A span extension point is returned, shown by the vertical line (914).

The preceding three plots 905, 906 and 907 demonstrate various examples of procedures outlined in the last section. As the collection of data increases, the retained set is curtailed to the desired number $m_r$ so as to ensure data reliability with changing conditions. That is, the most recent samples representative of the well behavior can be used for evaluation purposes. This allows the procedure to trace and track the vicinity of the optimum with ongoing changes in underlying conditions, often the consequence of declining reservoir pressure. The latter however, is the longer-term time constant. In the near-term, the variations in response are due to the noisy nature of the system. That is, variability stemming from set-point fluctuations, well dynamics of complex multiphase flow, and the reliability of measurements. The intent of the proposed procedure is that it is sufficiently robust under these conditions to furnish a sequence of set-points that optimize the expected value.

The application of the procedure is demonstrated on a noisy function over 50 iterations commencing with an initial and retained dataset of 8 samples. The polynomial steps are shown in the plot 908 and the distribution of the set-points identified are shown in the plot 909. Lastly, the collection of samples (circles) are shown on one realization of the underlying noisy function in the plot 910. The expected value is 189.8, with most samples placed in the range 860-890 as shown in the plot 909. Notably, these are near the estimated peak of the noisy function as shown in the plot 910.

Single Well—Case 2—Noisy—Excess Gas

Figure 10:
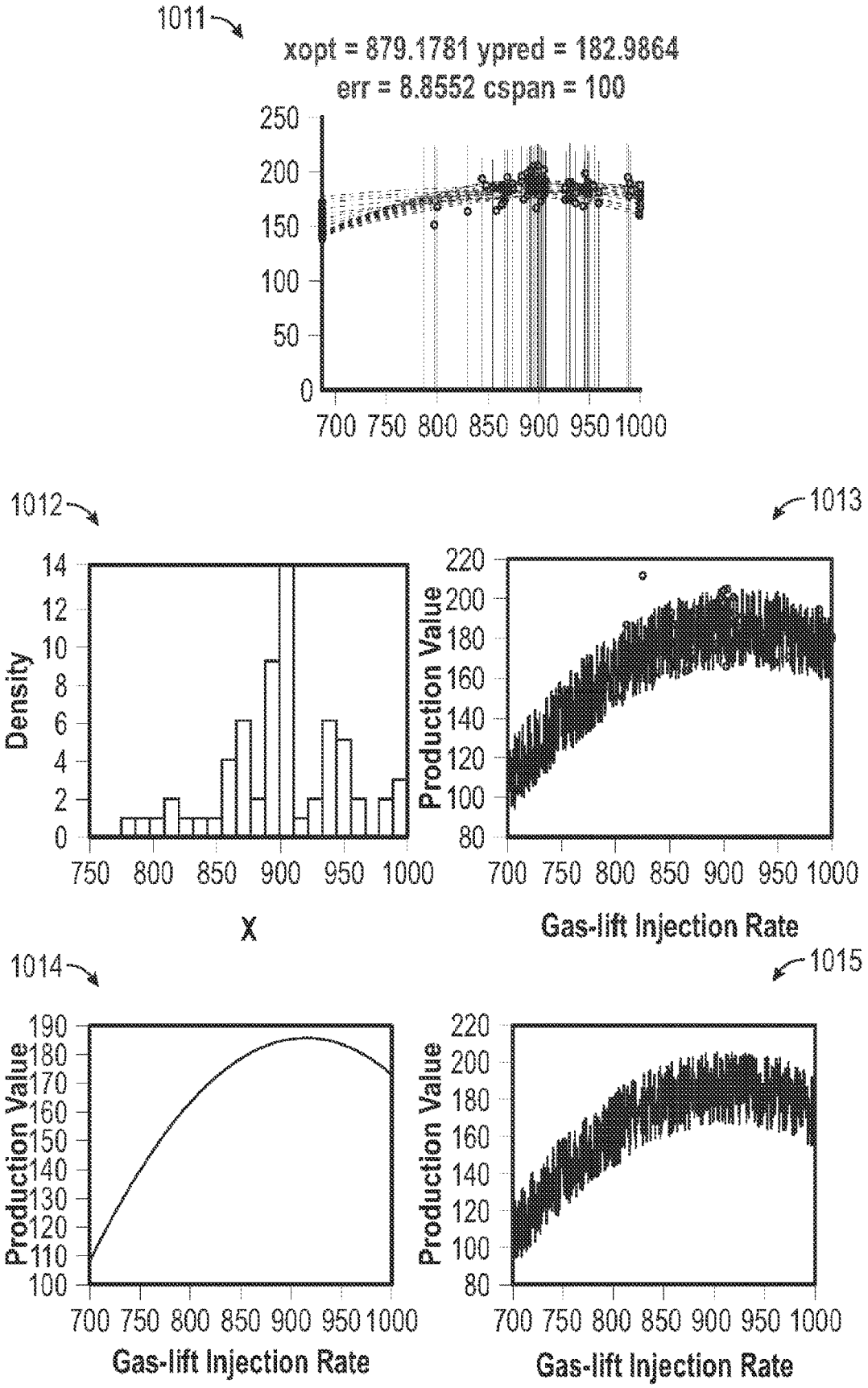
FIG. 10 illustrates examples of plots.

Similar plots to those shown in the section above are presented here for a different test case. As before, 50 iterations are executed with an initial and retained set of 8 samples. FIG. 10 shows plots 1011, 1012, 1013, 1014 and 1015. The polynomial steps are shown in the plot 1011, the distribution of the set-points in the plot 1012 and the samples on the underlying noisy function in the plot 1013. The expected value for this case is 182.5 with many samples placed in the 900 range, as shown in the plot 1012. These are near the estimated peak of the noisy function as shown in the plot 1013. For completeness, the GLPC used for this case is shown without noise in the plot 1014 and with noise in the plot 1015.

Two Wells—Case 1—Noisy—Excess Gas

The results for a two well case with noise and excess gas are presented in this section.

Figure 11:
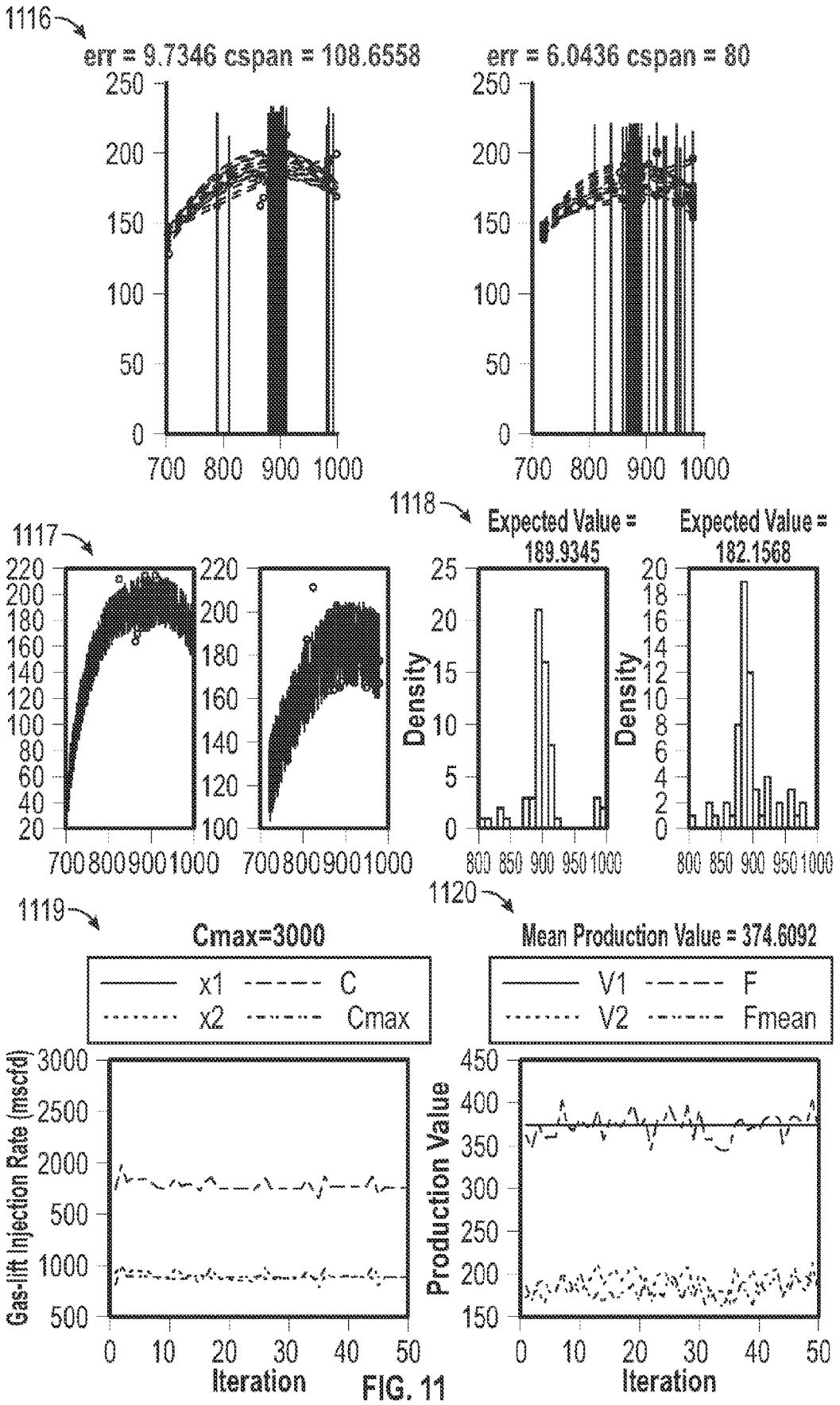
FIG. 11 illustrates examples of plots.

FIG. 11 shows various plots 1116, 1117, 1118, 1119 and 1120. The procedure iterations are given in the plot 1116 and the associated distribution of set points are given in the plot 1117 for both wells. The expected value for each is 189.9 and 182.2, respectively, not unlike the single-well results in the preceding sections.

The samples (circles) and underlying functions with noise (the curves) are shown in the plot 1118. The horizontal lines indicate the expected value achieved in each well as noted in the plot 1118.

The gas-lift rate by iteration is shown in the plot 1119 for each well (lower curves). The cumulative rate (upper curve) is less than the limit of 3000 Mscfd shown in horizontal line (top).

The well response variation by iteration is shown in the plot 1120 for both wells (bottom curves). The cumulative objective measure F is shown in top curve, with the expected value of 374.6 over 50 iterations given by the horizontal line.

Two Wells—Case 2—Noisy—Gas Limit

The results for a two well case with noise and an available gas limit are presented in this section.

Figure 12:
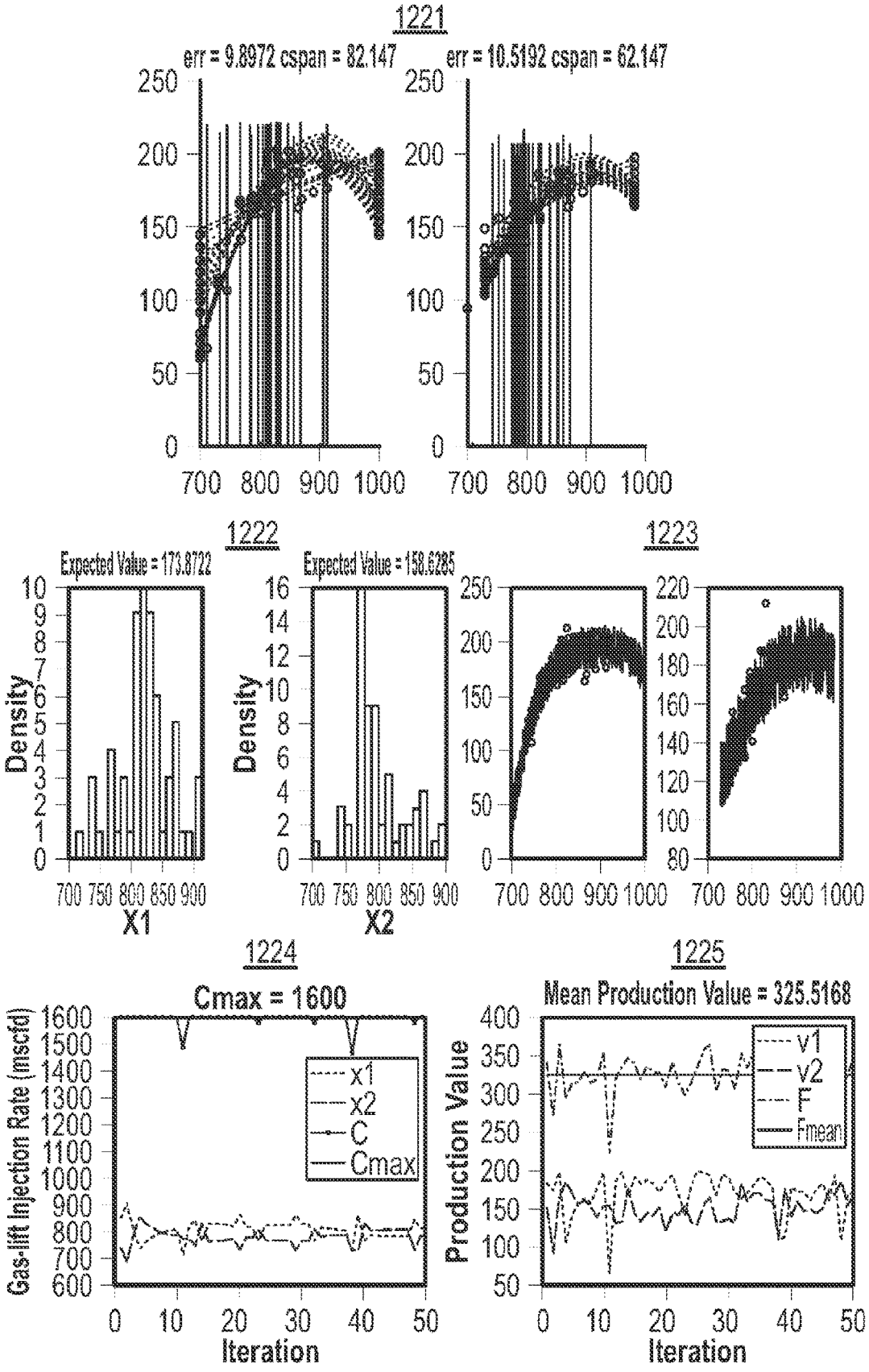
FIG. 12 illustrates examples of plots.

FIG. 12 shows plots 1221, 1222, 1223, 1224 and 1225. The procedure iterations are given in the plot 1221 and the associated distribution of set points are given in the plot 1222 for both wells. The expected value for each is 173.9 and 158.6, respectively.

The samples and underlying functions with noise are shown in the plot 1223 in which the horizontal lines indicate the expected values achieved.

The gas-lift rate by iteration is shown in the plot 1224. In this case, the distribution is limited to the 1600 Mscfd of available lift gas.

The well response variation by iteration is shown in the plot 1225 along with the cumulative measure and the expected value of 325.5.

Two Wells—Case 3—No Noise—Excess Gas

The results for a two well case with zero additive noise and excess lift gas are presented in this section.

Figure 13:
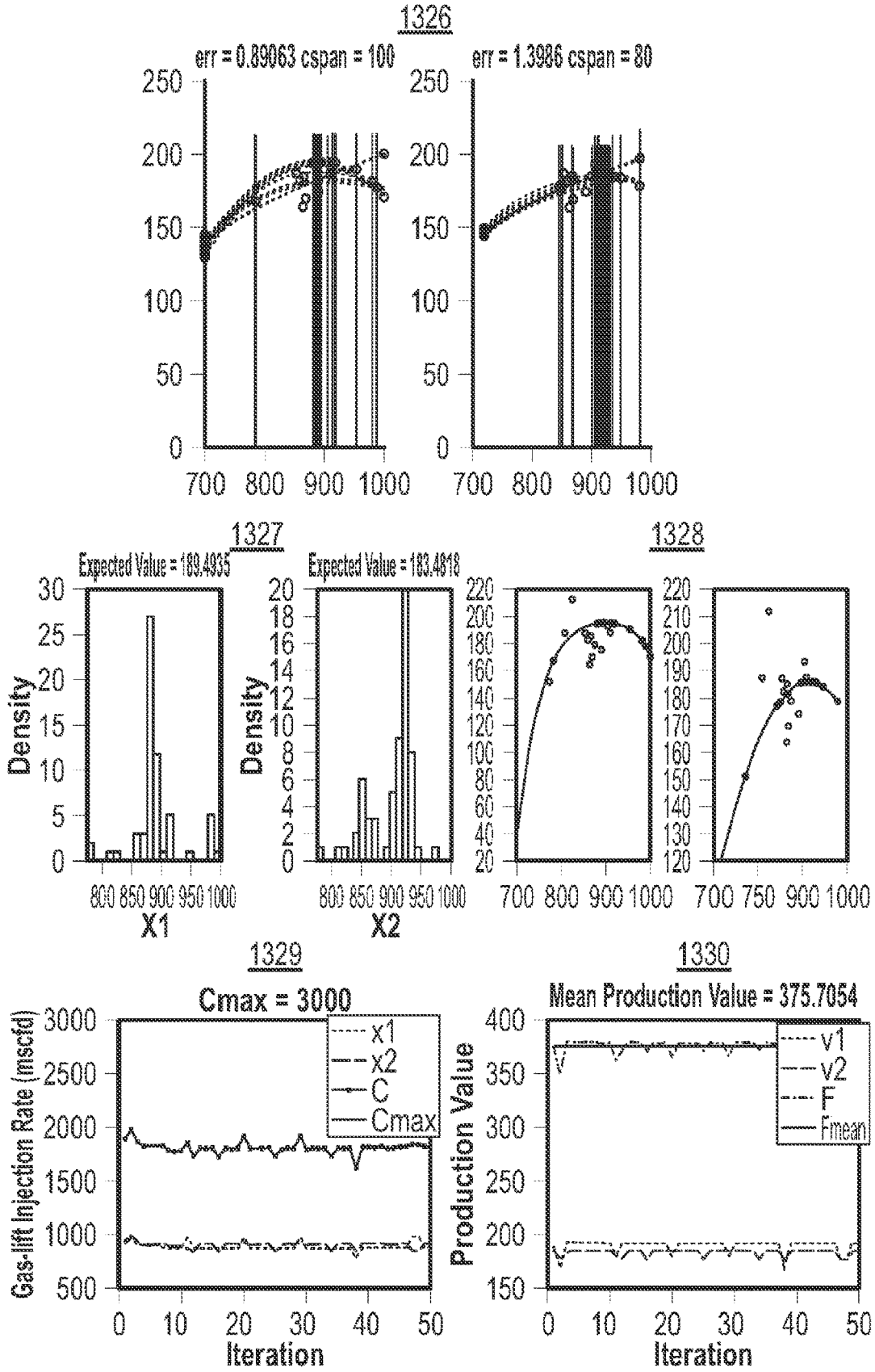
FIG. 13 illustrates examples of plots.

FIG. 13 shows plots 1326, 1327, 1328, 1329 and 1330. The procedure iterations are given in the plot 1326 and the associated distribution of set points are given in the plot 1327 for both wells. The expected value for each is 189.5 and 183.5, respectively.

The samples and underlying functions are shown in the plot 1328. The lines indicate the expected values achieved. Note that the circles appearing off the curves are real field samples used to construct the representative gas-lift performance curves for testing purposes.

The gas-lift rate by iteration is shown in the plot 1329 and the well response variation by iteration is shown in the plot 1330 with an expected value of 375.7.

It is worth noting that the Noisy—Excess Gas case returned an expected value of 374.6 that is slightly lower than the present No Noise—Excess Gas case.

Two Wells—Case 4—No Noise—Gas Limit

The results for a two well case with zero additive noise and a limited amount of lift gas are presented in this section.

Figure 14:
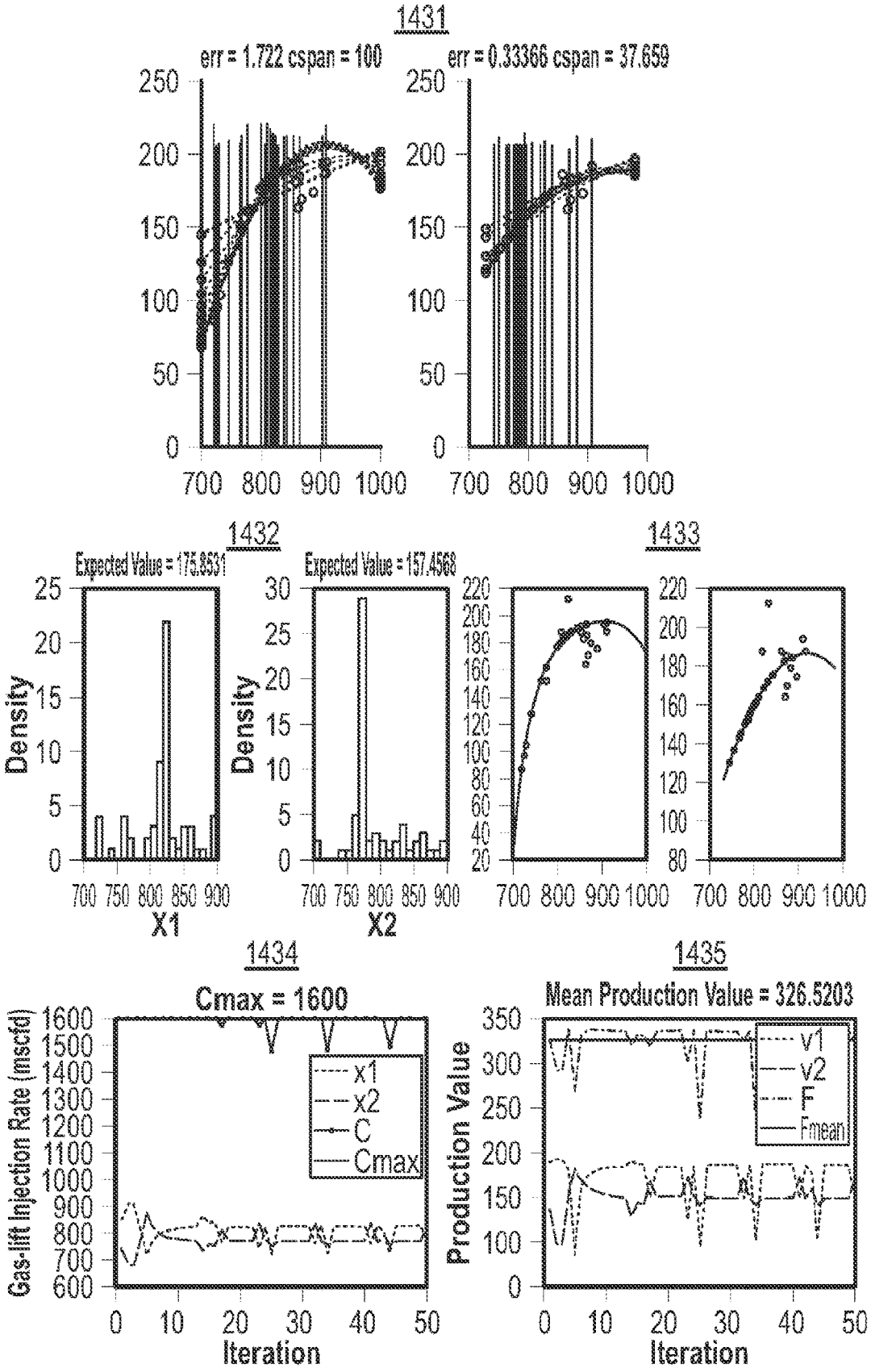
FIG. 14 illustrates examples of plots.

FIG. 14 shows plots 1431, 1432, 1433, 1435 and 1436. The procedure iterations are given in the plot 1431 and the associated distribution of set points are given in the plot 1432 for both wells. The expected value for each is 175.9 and 157.5, respectively.

The samples and underlying functions are shown in the plot 1433, where the lines indicate the expected values achieved. As noted above, the circles that are non-coincident on the curves are real field samples.

The gas-lift rate by iteration is shown in the plot 1434 and is in accordance with the stipulated limit of 1600 Mscfd. The well response variation by iteration is shown in the plot 1435 and has an expected value of 326.5.

It is worth noting that the Noisy—Gas Limit case returned an expected value of 325.5 that is slightly lower than the present Noisy—Gas Limit case.

As explained, various example methods may be applied for control in continuous gas-lift optimization schemes. A control scheme can utilize one or more approaches, for example, to handle noisy well responses. Various example trials show two single-well cases with noisy functions developed using real data samples, which handle changing well behavior with time. In addition, various two-well cases with excess or limited lift-gas with either noisy or smooth underlying representative gas-lift performance curves were handled via one or more example methods. Efficacy of various example methods is demonstrated to be robust in handling noisy responses over multiple wells with the aim to maximize the long-term expected value of the production (e.g., in place of a single optimum, as in past work, that in actuality is hard to attain).

Example Method

Figure 15:
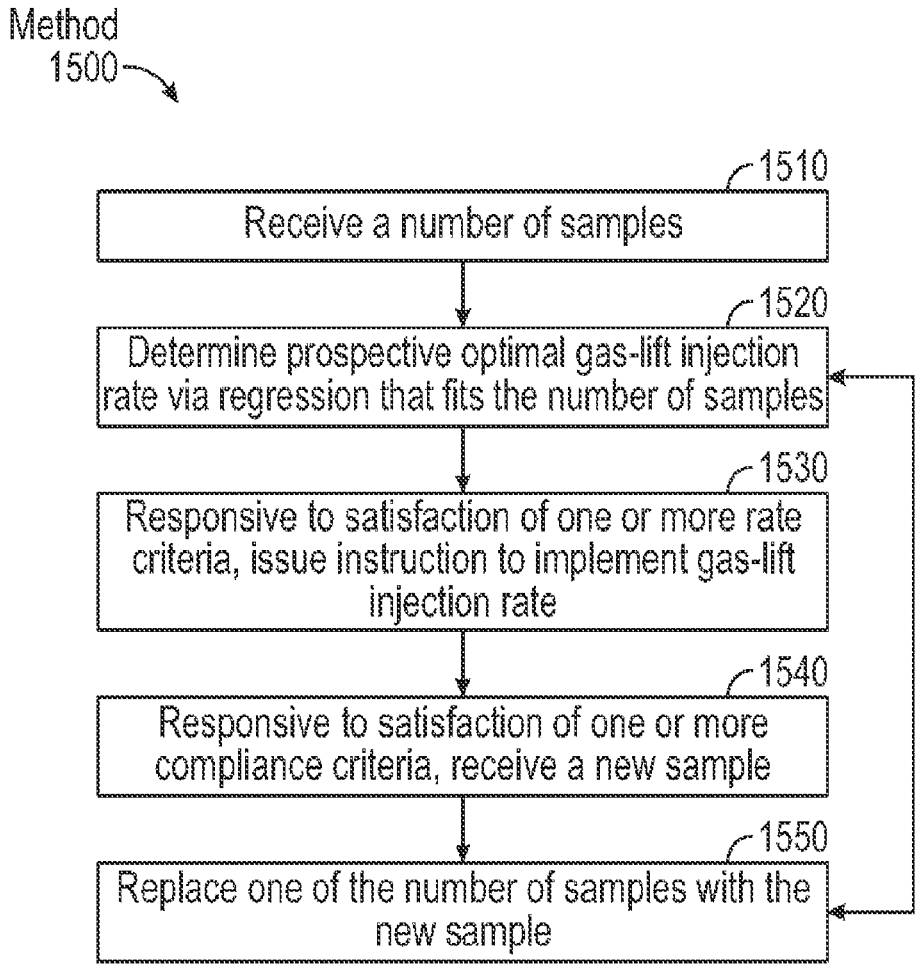
FIG. 15 illustrates an example of a method.

FIG. 15 shows an example of a method 1500 that includes a reception block 1510 for receiving a number of samples, a determination block 1520 for determining a prospective optimal gas-lift injection rate via regression that fits the number of samples, an issuance block 1530 for issuing an instruction to implement the prospective optimal gas-lift injection rate responsive to satisfaction of one or more rate criteria, a reception block 1540 for receiving a new sample responsive to satisfaction of one or more compliance criteria and a replacement block 1550 for replacing one of the number of samples with the new sample. In such an example, the number of samples can be a pre-defined number or otherwise determined number where one or more samples can be replaced (e.g., deleted and updated with a new sample). The method 1500 may be applied to a single well or to multiple wells where, for example, one or more constraints may be applied to a multiple well scenario (e.g., a common source of gas, etc.). As shown, the method 1500 can include a loop. For example, the method 1500 can proceed from the replacement block 1550 to the determination block 1520 in an iterative manner where the timing of the loop (e.g., iteration timing) may be determined at least in part via one or more of the compliance criteria (see, e.g., C1 and C2), which can be for one or more of stability of measurement, equilibrium, etc.

As an example, the number of samples may be selected to retain a history that extends back in time a desired period. In such an example, one or more compliance criteria may be determinative of the time period. For example, where physics are slow, equilibrium may take a longer time and hence control how often a new sample is generated. In such an example, a long period of time may be balanced against a fewer number of samples to tailor the history (e.g., lookback window) of the samples. As an example, where dynamics are quite rapid, the number of samples may be adjusted to tailor the history (e.g., lookback window) of the samples. As explained, one or more techniques may be utilized in the method 1500 to effectuate a forgetting approach to samples.

As explained, gas-lift injection rate criteria can include, for example, criteria such as bounds, etc., and compliance criteria can include, for example, criteria related to measurements and/or physics (e.g., physical phenomena, etc.).

As an example, the method 1500 may commence once a number of samples (e.g., $m_r$) have been collected. As explained, a sample can include gas-lift rate and one or more flow rates as measured, for example, for liquid, oil, water, and gas.

As an example, a regression can provide for fitting of a gas-lift performance curve (Qliq versus lift-gas). As an example, a production value may be derived from one or more parameters that may be specified by a user, for example, to impart flexibility to set an objective measure. As an example, one or more parameters may be related to practicality of operations. For example, if production does not produce desired fluid at a sufficient rate to cover costs of gas-lift, then a decision may be made to cease gas-lift. As an example, various types of information may be utilized for optimization, for example, to optimize the total production value over a number of wells.

As explained, a method may be applied for a single well or multiple wells where the number of samples may remain constant (e.g., $m_r$), noting that anchor points may be considered though may or may not be included in that number. As an example, one or more anchor points can be inserted as pseudo samples where the one or more anchor points may be obtained from a regression (e.g., polynomial, etc.) as part of a method. As an example, a polynomial may be utilized for curve fitting. For example, consider a second order (quadratic) curve that can provide a desired shape of an underlying gas-lift performance curve. One or more types of equations may be utilized for fitting where the number of samples is sufficient without tending toward overfitting the samples. Overfitting may result in minima or maxima that do not represent the underlying physics of a gas-lift performance curve. Where such artefacts exist, it may be more difficult to determine a global optimum. As an example, a method can include an assessment block for assessing a fitting result, for example, as to sufficiency of number of samples and/or overfitting.

As explained, an approach can be dynamic, iterative, and data-driven where the number of samples limits history and where one or more criteria such as C1 and C2 (e.g., compliance criteria) can limit time of getting a new sample. If C1 and/or C2 is long, then time for stability and/or equilibrium can impact how often a new sample is generated (e.g., to replace the oldest sample in the set).

As an example, a method can include receiving a number of samples of liquid production values and associated gas-lift injection rates for one of one or more wells, where the number of samples equals a pre-defined sample number; determining a prospective optimal gas-lift injection rate for the one of the one or more wells via a regression that fits the number of samples; responsive to the prospective optimal gas-lift injection rate satisfying one or more gas-lift injection rate criteria, issuing an instruction to implement the prospective optimal gas-lift injection rate for the one of the one or more wells; receiving a new sample as a measured liquid production value for the implemented prospective optimal gas-lift injection rate and responsive to satisfaction of one or more compliance criteria; and replacing one of the number of samples with the new sample.

Example Controllers

Figure 16:
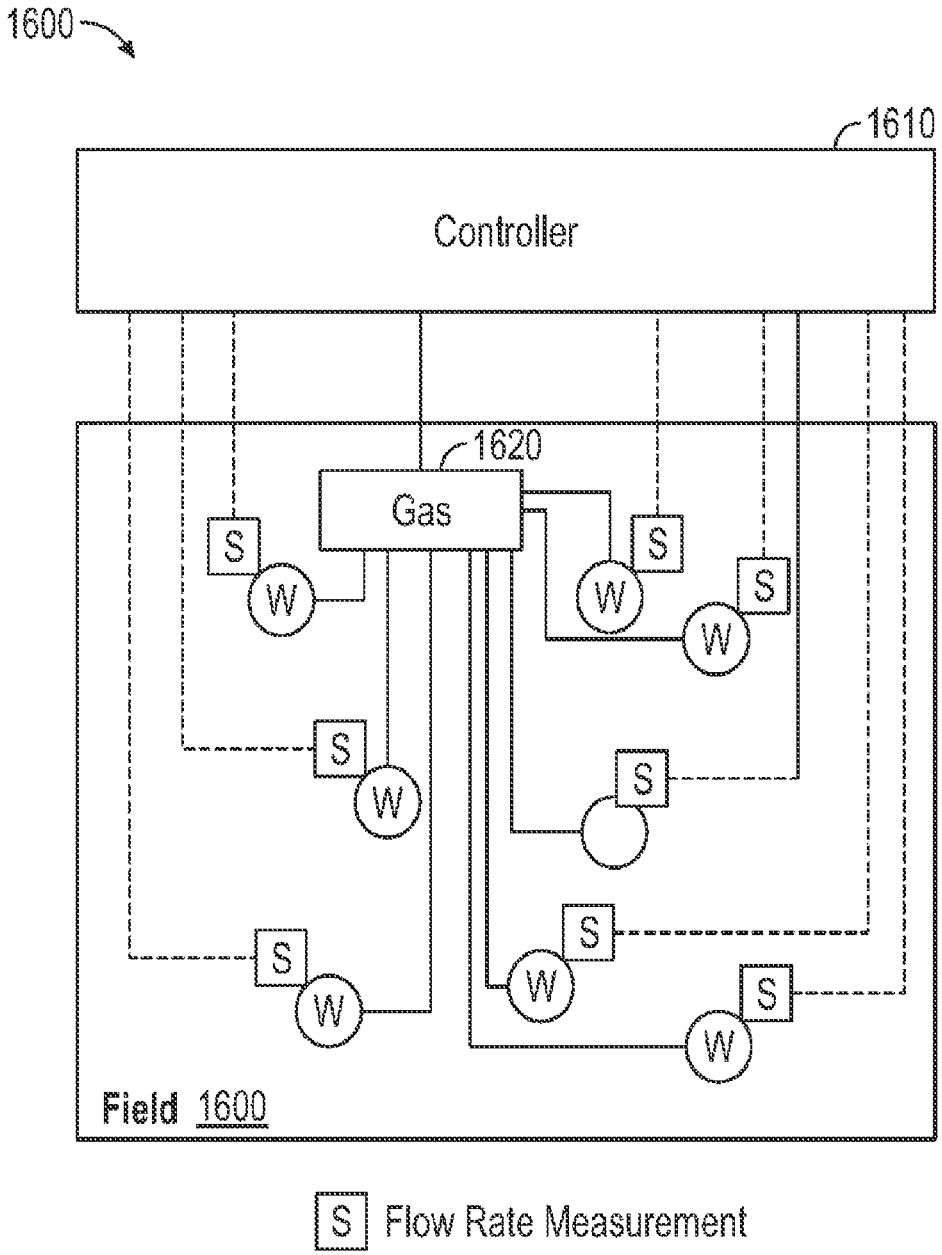
FIG. 16 illustrates an example of a controller.

FIG. 16 shows an example of a controller 1610 with respect to a field 1600 that includes wells (W), sensors (S) and a supply of gas 1620. As shown, the controller 1610 can issue instructions to the field 1600 such that gas from the gas supply 1620 may be controlled at a manifold and/or locally (e.g., well-by-well, etc.). As an example, a wired and/or a wireless network may be utilized for control and/or receipt of measurements from the sensors (S).

Figure 17:
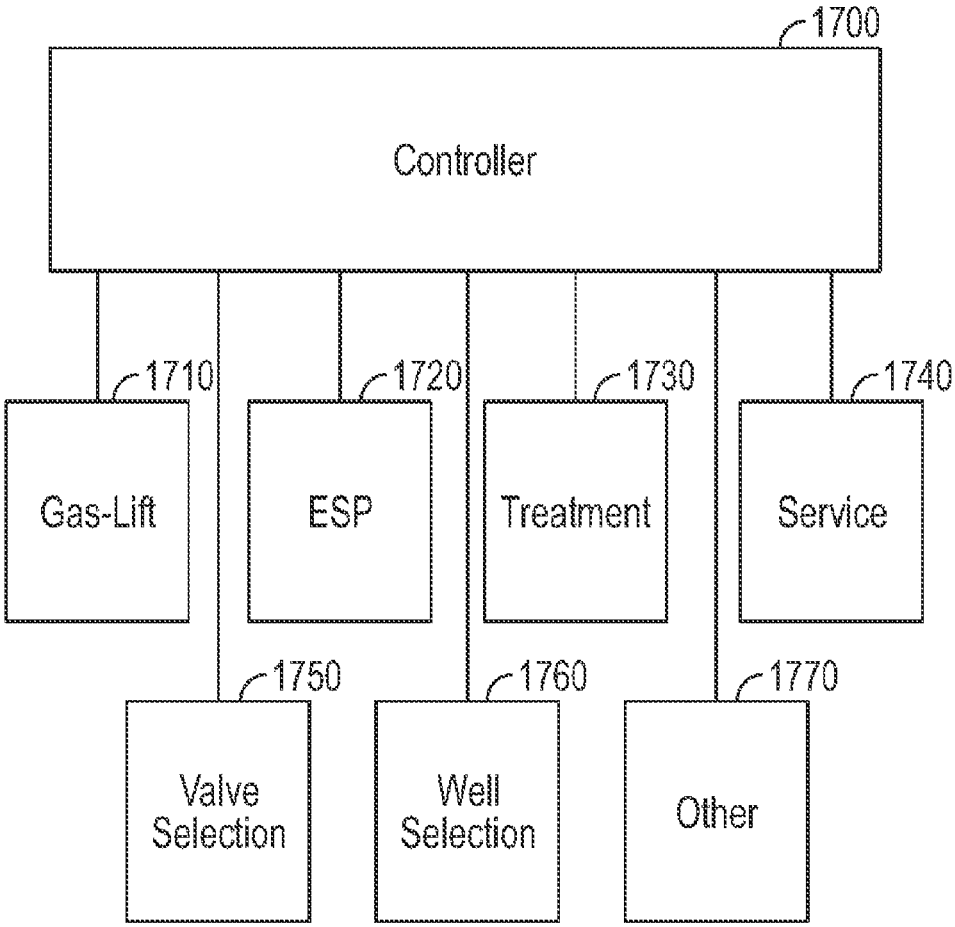
FIG. 17 illustrates an example of a controller.

FIG. 17 shows an example of a controller 1700, which may be implemented as the controller 1610 of FIG. 16. In the example of FIG. 17, the controller 1700 can include one or more components such as, for example, one or more of a gas-lift component 1710, an electric submersible pump component 1720, a treatment component 1730, a service component 1740, a valve selection component 1750, a well selection component 1760 and one or more other components 1770. As explained, information gleaned via control such as according to the method 1500 may be utilized to determine one or more actions that may aim to improve production, improve operation of equipment (e.g., valves, etc.), improve utilization of one or more resources (e.g., gas, electricity for an ESP, chemical injection, etc.).

As an example, a method can include receiving a number of samples of liquid production values and associated gas-lift injection rates for one of one or more wells, where the number of samples equals a pre-defined sample number; determining a prospective optimal gas-lift injection rate for the one of the one or more wells via a regression that fits the number of samples; responsive to the prospective optimal gas-lift injection rate satisfying one or more gas-lift injection rate criteria, issuing an instruction to implement the prospective optimal gas-lift injection rate for the one of the one or more wells; receiving a new sample as a measured liquid production value for the implemented prospective optimal gas-lift injection rate and responsive to satisfaction of one or more compliance criteria; and replacing one of the number of samples with the new sample. In such an example, the number of samples can include gas production values and can include oil production values, water production values and gas production values.

As an example, a regression can utilize a polynomial, which may be a polynomial of an order of two.

As an example, a pre-defined sample number can correspond to one of one or more wells where, for example, each of the one or more wells may have its own pre-defined sample number. As an example, a pre-defined sample number can depend on physical phenomena associated with well production.

As an example, a method can include receiving a number of samples iteratively, for example, sample-by-sample.

As an example, one or more gas-lift injection rate criteria can include at least one bound. As an example, one or more compliance criteria can include a stability criterion and/or an equilibrium criterion.

As an example, replacing one of a number of samples with a new sample can generate an updated number of samples where a method can include determining a new prospective optimal gas-lift injection rate for the one of the one or more wells via a new regression that fits the updated number of samples.

As an example, a prospective optimal gas-lift injection rate can depend on a gas supply constraint.

As an example, a prospective optimal gas-lift injection rate can depend on a gas supply constraint for supply of lift-gas to a plurality of wells.

As an example, a method can include receiving a new sample by receiving digital data generated by one or more sensors.

As an example, a method can include analyzing a result of a regression for an indication of an issue. For example, consider one or more of a production issue, a valve issue, a gas supply issue, a scaling issue, and an energy issue. In such an example, a result may be compared to one or more other wells and/or past results. As an example, a trained machine learning model may be utilized to detect one or more issues. For example, consider a labeled set of regression results, which may be actual, simulated, actual and simulated, etc., that can be utilized to train a machine learning model (e.g., a neural network, etc.). Once trained, a method can include analyzing a regression result using the trained machine learning model to detect or predict a likelihood of an issue or issues. As mentioned, an issue may be a scaling issue where scaling of a valve can be mitigated via servicing, chemical treatment, etc. As an example, measurements may be analyzed, for example, with respect to noise or types of noise. For example, scaling or other issues may present certain behavior or noise in measurement data (e.g., sensor data). As an example, a machine learning approach may be utilized to detect one or more issues using one or more types of input.

As to types of machine learning models, consider one or more of a support vector machine (SVM) model, a k-nearest neighbors (KNN) model, an ensemble classifier model, a neural network (NN) model, etc. As an example, a machine learning model can be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model, may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange with various other frameworks.

As an example, the TENSORFLOW framework (Google LLC, Mountain View, CA) may be implemented, which is an open-source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations can be expressed as stateful dataflow graphs; noting that the name TENSORFLOW derives from the operations that such neural networks perform on multidimensional data arrays. Such arrays can be referred to as "tensors".

As an example, a system can include one or more processors; memory accessible to at least one of the one or more processors; processor-executable instructions stored in the memory and executable to instruct the system to: receive a number of samples of liquid production values and associated gas-lift injection rates for one of one or more wells, where the number of samples equals a pre-defined sample number; determine a prospective optimal gas-lift injection rate for the one of the one or more wells via a regression that fits the number of samples; responsive to the prospective optimal gas-lift injection rate satisfying one or more gas-lift injection rate criteria, issue an instruction to implement the prospective optimal gas-lift injection rate for the one of the one or more wells; receive a new sample as a measured liquid production value for the implemented prospective optimal gas-lift injection rate and responsive to satisfaction of one or more compliance criteria; and replace one of the number of samples with the new sample.

As an example, one or more computer-readable storage media can include processor-executable instructions to instruct a computing system to: receive a number of samples of liquid production values and associated gas-lift injection rates for one of one or more wells, where the number of samples equals a pre-defined sample number; determine a prospective optimal gas-lift injection rate for the one of the one or more wells via a regression that fits the number of samples; responsive to the prospective optimal gas-lift injection rate satisfying one or more gas-lift injection rate criteria, issue an instruction to implement the prospective optimal gas-lift injection rate for the one of the one or more wells; receive a new sample as a measured liquid production value for the implemented prospective optimal gas-lift injection rate and responsive to satisfaction of one or more compliance criteria; and replace one of the number of samples with the new sample.

As an example, a computer program product can include one or more computer-readable storage media that can include processor-executable instructions to instruct a computing system to perform one or more methods and/or one or more portions of a method.

Figure 18:
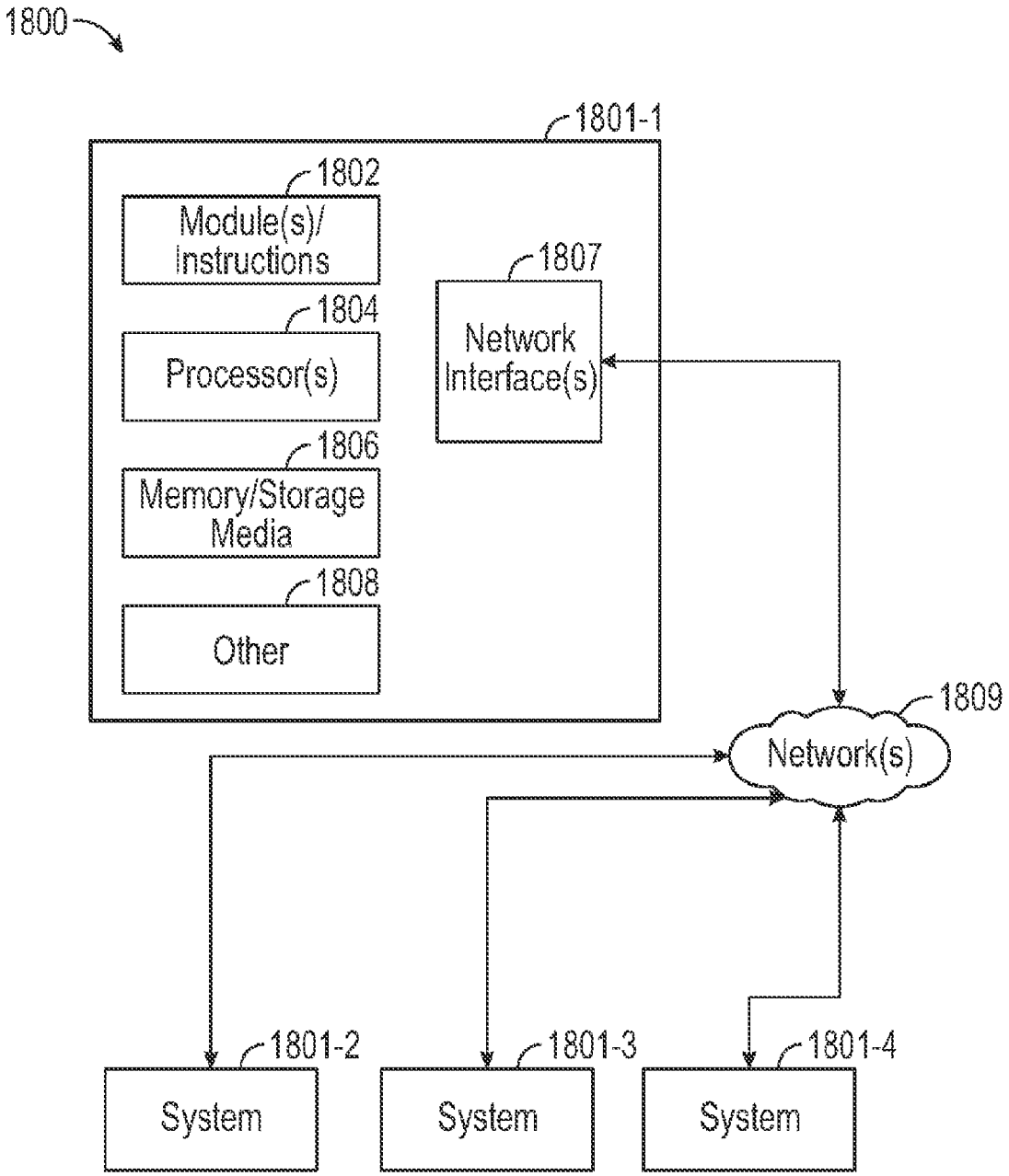
FIG. 18 illustrates examples of computer and network equipment.

In some embodiments, a method or methods may be executed by a computing system. FIG. 18 shows an example of a system 1800 that can include one or more computing systems 1801-1, 1801-2, 1801-3 and 1801-4, which may be operatively coupled via one or more networks 1809, which may include wired and/or wireless networks.

As an example, a system can include an individual computer system or an arrangement of distributed computer systems. In the example of FIG. 18, the computer system 1801-1 can include one or more modules 1802, which may be or include processor-executable instructions, for example, executable to perform various tasks (e.g., receiving information, requesting information, processing information, simulation, outputting information, etc.).

As an example, a module may be executed independently, or in coordination with, one or more processors 1804, which is (or are) operatively coupled to one or more storage media 1806 (e.g., via wire, wirelessly, etc.). As an example, one or more of the one or more processors 1804 can be operatively coupled to at least one of one or more network interface 1807. In such an example, the computer system 1801-1 can transmit and/or receive information, for example, via the one or more networks 1809 (e.g., consider one or more of the Internet, a private network, a cellular network, a satellite network, etc.).

As an example, the computer system 1801-1 may receive from and/or transmit information to one or more other devices, which may be or include, for example, one or more of the computer systems 1801-2, etc. A device may be located in a physical location that differs from that of the computer system 1801-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1806 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICs, FPGAs, PLDs, or other appropriate devices.

Figure 19:
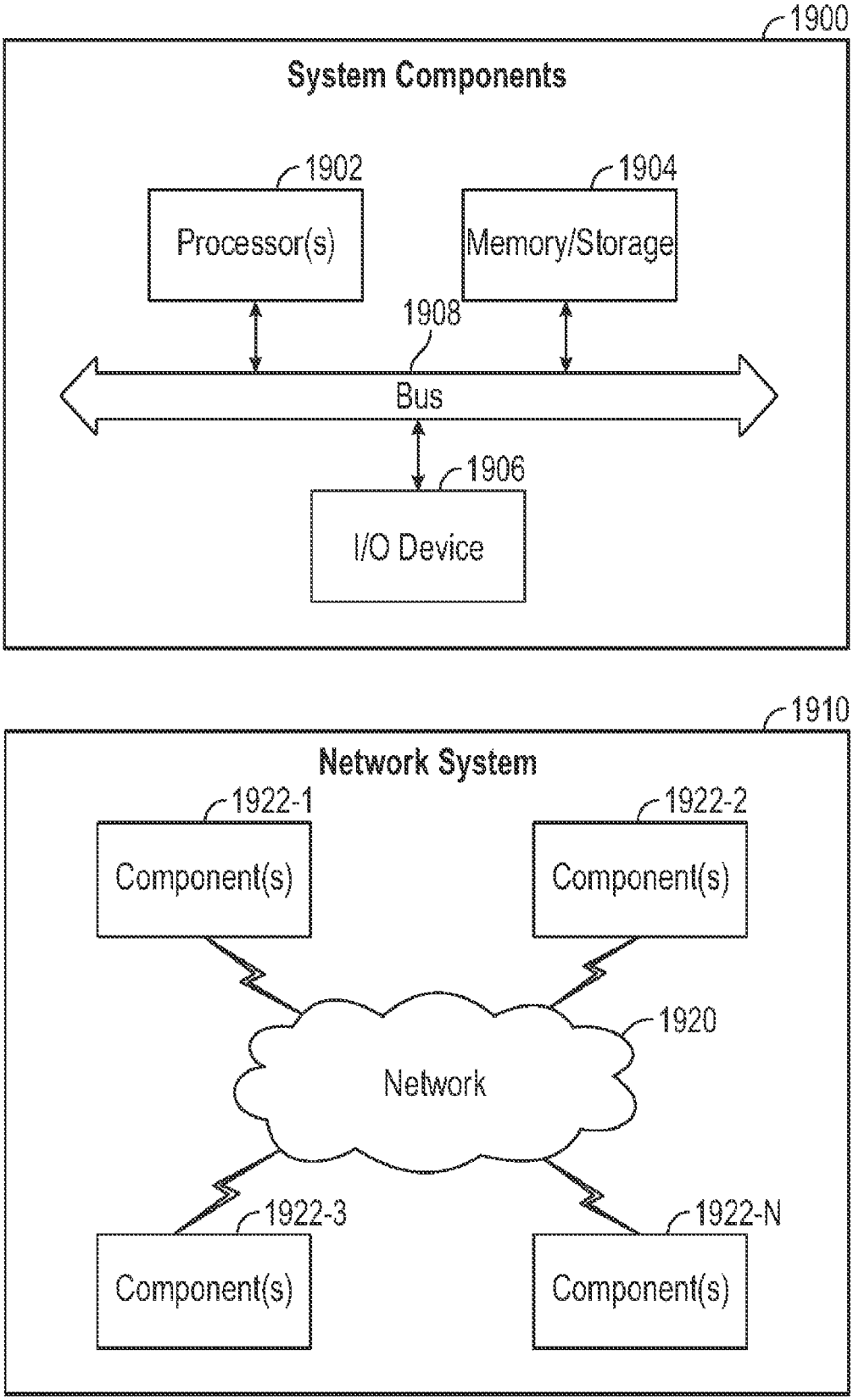
FIG. 19 illustrates example components of a system and a networked system.

FIG. 19 shows components of an example of a computing system 1900 and an example of a networked system 1910 with a network 1920. The system 1900 includes one or more processors 1902, memory and/or storage components 1904, one or more input and/or output devices 1906 and a bus 1908. In an example embodiment, instructions may be stored in one or more computer-readable media (e.g., memory/storage components 1904). Such instructions may be read by one or more processors (e.g., the processor(s) 1902) via a communication bus (e.g., the bus 1908), which may be wired or wireless. The one or more processors may execute such instructions to implement (wholly or in part) one or more attributes (e.g., as part of a method). A user may view output from and interact with a process via an I/O device (e.g., the device 1906). In an example embodiment, a computer-readable medium may be a storage component such as a physical memory storage device, for example, a chip, a chip on a package, a memory card, etc. (e.g., a computer-readable storage medium).

In an example embodiment, components may be distributed, such as in the network system 1910. The network system 1910 includes components 1922-1, 1922-2, 1922-3, . . . 1922-N. For example, the components 1922-1 may include the processor(s) 1902 while the component(s) 1922-3 may include memory accessible by the processor(s) 1902. Further, the component(s) 1922-2 may include an I/O device for display and optionally interaction with a method. The network 1920 may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

receiving a number of samples of liquid production values and associated gas-lift injection rates for one of one or more wells, wherein the number of samples equals a pre-defined sample number;

determining a prospective optimal gas-lift injection rate for the one of the one or more wells via a regression that fits the number of samples;

responsive to the prospective optimal gas-lift injection rate satisfying one or more gas-lift injection rate criteria, issuing an instruction to implement the prospective optimal gas-lift injection rate for the one of the one or more wells;

receiving a new sample as a measured liquid production value for the implemented prospective optimal gas-lift injection rate and responsive to satisfaction of one or more compliance criteria; and replacing one of the number of samples with the new samples;

wherein:

the number of samples of liquid production values and the associated gas-lift injection rates are associated with a first anchor point comprising a lower bound gas-injection rate and a lower bound liquid production value and a second anchor point comprising an upper bound gas-injection rate and an upper bound liquid production value;

the new sample is associated with a new lower bound liquid production value, a new upper bound liquid production value, a new lower bound gas-lift injection rate, and a new upper bound gas-lift injection rate determined based on the implemented prospective optimal gas-lift injection rate; and further comprising:

updating the first anchor point and the second anchor point to include the new lower gas injection rate and the new upper bound gas injection rate, respectively;

upon determining that the new lower bound liquid production value is less than the lower bound liquid production value, updating the first anchor point to include the new lower bound liquid production value;

upon determining that the new upper bound liquid production value is less than the upper bound liquid production value, updating the second anchor point to include the new upper bound liquid production value;

determining an updated optimal gas-lift injection rate for the one or more wells based on an updated number of samples including the new sample via the regression that fits the updated number of samples; and issuing an instruction to a valve connected to a compressor to implement the updated optimal gas-lift injection rate for the one or more wells.

2. The method of claim 1, wherein the number of samples comprise gas production values.

3. The method of claim 1, wherein the number of samples comprise oil production values, water production values and gas production values.

4. The method of claim 1, wherein the regression utilizes a polynomial.

5. The method of claim 4, wherein the polynomial is of an order of two.

6. The method of claim 1, wherein the pre-defined sample number corresponds to the one of the one or more wells.

7. The method of claim 1, wherein each of the one or more wells comprises its own pre-defined sample number.

8. The method of claim 1, wherein the pre-defined sample number depends on physical phenomena associated with well production.

9. The method of claim 1, wherein the receiving occurs iteratively sample-by-sample.

10. The method of claim 1, wherein the one or more compliance criteria comprise a stability criterion.

11. The method of claim 1, wherein the one or more compliance criteria comprise an equilibrium criterion.

12. The method of claim 1, wherein the prospective optimal gas-lift injection rate depends on a gas supply constraint.

13. The method of claim 1, wherein the prospective optimal gas-lift injection rate depends on a gas supply constraint for supply of lift-gas to a plurality of wells.

14. The method of claim 1, comprising:

analyzing a result of the regression for an indication of an issue.

15. The method of claim 14, wherein the issue comprises one or more of a production issue, a valve issue, a gas supply issue, a scaling issue, and an energy issue.

16. A system comprising:

one or more processors;

memory accessible to at least one of the one or more processors;

processor-executable instructions stored in the memory and executable to instruct the system to:

receive a number of samples of liquid production values and associated gas-lift injection rates for one of one or more wells, wherein the number of samples equals a pre-defined sample number;

determine a prospective optimal gas-lift injection rate for the one of the one or more wells via a regression that fits the number of samples; responsive to the prospective optimal gas-lift injection rate satisfying one or more gas-lift injection rate criteria, issue an instruction to implement the prospective optimal gas-lift injection rate for the one of the one or more wells;

receive a new sample as a measured liquid production value for the implemented prospective optimal gas-lift injection rate and responsive to satisfaction of one or more compliance criteria; and replace one of the number of samples with the new sample-;

wherein:

the number of samples of liquid production values and the associated gas-lift injection rates are associated with a first anchor point comprising a lower bound gas-injection rate and a lower bound liquid production value and a second anchor point comprising an upper bound gas-injection rate and an upper bound liquid production value;

the new sample is associated with a new lower bound liquid production value, a new upper bound liquid production value, a new lower bound gas-lift injection rate, and a new upper bound gas-lift injection rate determined based on the implemented prospective optimal gas-lift injection rate; and further comprising:

updating the first anchor point and the second anchor point to include the new lower gas injection rate and the new upper bound gas injection rate, respectively;

upon determining that the new lower bound liquid production value is less than the lower bound liquid production value, updating the first anchor point to include the new lower bound liquid production value;

upon determining that the new upper bound liquid production value is less than the upper bound liquid production value, updating the second anchor point to include the new upper bound liquid production value;

determining an updated optimal gas-lift injection rate for the one or more wells based on an updated number of samples including the new sample via the regression that fits the updated number of samples; and issuing an instruction to a valve connected to a compressor to implement the updated optimal gas-lift injection rate for the one or more wells.

17. One or more computer-readable storage media comprising processor-executable instructions to instruct a computing system to:

receive a number of samples of liquid production values and associated gas-lift injection rates for one of one or more wells, wherein the number of samples equals a pre-defined sample number;

determine a prospective optimal gas-lift injection rate for the one of the one or more wells via a regression that fits the number of samples;

responsive to the prospective optimal gas-lift injection rate satisfying one or more gas-lift injection rate criteria, issue an instruction to implement the prospective optimal gas-lift injection rate for the one of the one or more wells;

receive a new sample as a measured liquid production value for the implemented prospective optimal gas-lift injection rate and responsive to satisfaction of one or more compliance criteria; and replace one of the number of samples with the new sample-;

wherein:

the number of samples of liquid production values and the associated gas-lift injection rates are associated with a first anchor point comprising a lower bound gas-injection rate and a lower bound liquid production value and a second anchor point comprising an upper bound gas-injection rate and an upper bound liquid production value;

the new sample is associated with a new lower bound liquid production value, a new upper bound liquid production value, a new lower bound gas-lift injection rate, and a new upper bound gas-lift injection rate determined based on the implemented prospective optimal gas-lift injection rate; and further comprising:

updating the first anchor point and the second anchor point to include the new lower gas injection rate and the new upper bound gas injection rate, respectively;

upon determining that the new lower bound liquid production value is less than the lower bound liquid production value, updating the first anchor point to include the new lower bound liquid production value;

upon determining that the new upper bound liquid production value is less than the upper bound liquid production value, updating the second anchor point to include the new upper bound liquid production value;

determining an updated optimal gas-lift injection rate for the one or more wells based on an updated number of samples including the new sample via the regression that fits the updated number of samples; and issuing an instruction to a valve connected to a compressor to implement the updated optimal gas-lift injection rate for the one or more wells.

* * * * *